US005819648A

United States Patent [19]

Megyesi

[11] Patent Number: 5,819,648

[45] Date of Patent: Oct. 13, 1998

[54] TWO PIECE PRINTING HEAD FOR DECORATOR CYLINDER WITH TAPERED SHAFT

[75] Inventor: Robert J. Megyesi, White House, Ohio

[73] Assignee: American National Can Company, Chicago, Ill.

[21] Appl. No.: 704,317

[22] Filed: Sep. 12, 1996

[51] Int. Cl.[6] ..... B41F 17/08

[52] U.S. Cl. ..... 101/38.1; 101/216; 101/383

[58] Field of Search ..... 101/41, 216, 38.1, 101/40, 40.1, 248, 382.1, 383, 153

[56] References Cited

U.S. PATENT DOCUMENTS

| | | | |
|---|---|---|---|
| 1,802,038 | 4/1931 | Springstead | 101/248 |
| 3,783,780 | 1/1974 | Saueressig | 101/216 |
| 4,380,964 | 4/1983 | Abe et al. | 101/38.1 |

OTHER PUBLICATIONS

Entire manual for operation, maintenance and parts replacement for Rutherford Container Decorator 6CD4–1600, Rutherford Machinery, a Division of Sequa Corporation, 401 Central Avenue, East Rutherford, New Jersey 07073 (author) (no date).

Entire manual for operation and maintenance of the Concord Decorator, Ragsdale Machinery Operations, a Division of Alcoa Packaging Machinery, Inc., 4535 South Santa Fe Drive, Englewood, CO 80110 (author) (no date).

*Primary Examiner*—Christopher A. Bennett
*Attorney, Agent, or Firm*—Wallenstein & Wagner, Ltd.

[57] ABSTRACT

The present invention is a printing head for a decorator cylinder assembly and comprises an interior member having a shaft bore and an outer side wall. The shaft bore has a tapered interior side wall. The printing head further comprises an exterior member having an inner side wall and a decorator side wall. The exterior member at least partially encompasses the interior member. The outer side wall of the interior member at least partially abuts the inner side wall of the exterior member, and the exterior member is adjustably connected about the interior member. The exterior member is at least partially axially adjustable about the interior cylinder, and is at least partially rotatably adjustable about the interior cylinder. The printing head further comprises a face plate/adjustment member adjustably connected to the interior member and the exterior member.

24 Claims, 16 Drawing Sheets

TWO PIECE PRINTING HEAD FOR DECORATOR CYLINDER WITH TAPERED SHAFT

TECHNICAL FIELD

The application relates to an apparatus for printing indicia onto containers, and more particularly, to decorator cylinders for printing ink onto printing pads, which in turn print the ink onto the containers.

BACKGROUND PRIOR ART

Containers are commonly used as a way to package and deliver beverage and other products to consumers within the marketplace. The containers typically take a generally cylindrical shape, such as 12 ounce soda-pop container. These containers are typically manufactured with indicia printed on the side (or side-wall) of the containers. These types of beverage containers are typically manufactured in two pieces. The first piece usually called a seamless container body, and consists of a bottom wall and a side wall extending from the bottom wall. The second piece typically consists of the container top (or end) which is seamed to the first piece at the top of the side-wall, after some typical forming steps, such as necking, and after the first piece of the container is filled with a beverage or food product.

Before the forming steps, the pouring step, and before the second piece (container end) is seamed to the first piece, indicia is typically printed on at least a portion of the side-wall of the beverage container. The indicia is typically printed in many colors, as is well known. For example, printing the indicia onto a beverage container typically includes printing background-like indicia onto a printing blanket in one color, and then printing lettering onto the printing blanket in areas which were not previously printed on, in another color (or in reverse order if the red is not behind the white). The image on the printing blanket is then printed onto the side-wall of the container. Silver coloration is typically not required due to the silver color of the aluminum alloy, from which many containers are made. Numerous other indicia, in numerous colors, can be printed onto a side-wall, via the printing blanket, as is well known.

The printing of indicia onto the container side-wall is typically known as container decoration. Container decorator machines are used to print one or more colors onto the containers for creating the indicia on the containers. These decorator machines are well known in the art of container decoration. One such decorator machine comprises a printing blanket wheel which rotates in a vertical plane about a central axis. The blanket wheel includes a plurality of printing blankets, spaced at substantially equal intervals about the circumference of the blanket wheel. The length of each printing blanket corresponds to the circumference of the containers for which the indicia will be printed, as will be explained in greater detail within the Detailed Description below. The decorator machine also comprises a plurality of inking stations. Each inking station includes a decorator cylinder having a printing head with a decorator printing plate. Each decorator printing plate includes an indicia pattern which represents at least a portion of the overall indicia pattern to be printed onto the container side-wall; the part of the overall indicia pattern which pertains to the color of that inking station. Each inking station also includes an assembly for applying the ink onto the decorator printing plate of the decorator cylinder.

Each inking station is capable of printing one color in a particular indicia pattern, onto the printing blankets.

Specifically, as the blanket wheel rotates, the printing blankets also rotate about the central axis, within the vertical plane of the blanket wheel, and pass by each inking station. As each blanket passes each inking station, the decorator printing plate of the decorator cylinder comes onto contact with the printing blanket at a point around the decorator printing plate which represents the beginning of the indicia pattern for that inking station. This occurs after ink is first impressed onto the indicia pattern on the decorator printing plate. The ink on the indicia pattern on the decorator printing plate is then rolled onto the printing blanket, as the blanket wheel rotates about the central axis. As the blanket wheel further rotates, the same printing blanket comes out of contact with the decorator printing plate for the above mentioned inking station, and then engages the next decorator printing plate at the next inking station. A different ink color, representing another portion of the overall indicia pattern, is then printed onto the printing blanket.

Once the same printing blanket has passed each inking station, wherein the printing blanket now has all of the colors for the overall indicia pattern printed onto the printing blanket, the printing blanket then comes into contact with the side-wall of the container. As the blanket wheel further rotates, the overall indicia pattern on the printing blanket impresses and prints onto the side-wall of the container. The length of the overall indicia pattern is typically a few millimeters longer than the circumference of the side-wall of the container, thereby causing an overlap region to be created during printing. This overlap region provides assurance that the beginning of the overall indicia pattern meets with the end of the overall indicia pattern.

With the use of decorator machines, for printing indicia patterns onto the side-walls of containers, comes several difficulties. Considerations in the design of this type of machine include aligning the several portions (colors from each inking station) of the overall pattern with one another before the overall indicia pattern is printed onto the container side-wall, as well as aligning the overall indicia pattern with the container side-wall. Specifically, alignment, or registry as sometimes referred to in the art, needs to take place in several dimensions. First, the image must be vertically positioned on the container side-wall in the appropriate location (horizontal during printing based on the container being on its side). Second, the indicia pattern from each printing station in the decorator machine must align properly with the other indicia patterns from the other printing stations. These and other alignment concerns have been addressed in the past with the use of an adjustable printing head, and as an alternative with the use of an adjustable printing shaft for adjusting the alignment of the printing head thereon.

Since the individual indicia patterns are printed onto the printing blanket with printing heads, there are two printing head alignments which are necessary. First, axial or horizontal alignment of the printing head is necessary for axially aligning the individual indicia patterns on the container side-wall in the correct side-wall position (position up and down a central axis running through the center of each container when the container is standing up), and in the correct axial position with respect to the other indicia patterns. Second, rotation or cylindrical alignment of the printing head is necessary for aligning the starting point, and ending point, of individual indicia patterns with one another.

There have been attempts to address these concerns in the past with the use of two different types of decorator machines. Specifically, one known decorator machine includes a decorator cylinder assembly having a printing head which is removably attached to a rotatable printing shaft. The rotation of the printing shaft causes the printing head, attached thereto, to rotate therewith. The printing shaft in this first type of decorator machine is not adjustable for the axial or cylindrical alignment of the indicia patterns, and other indicia alignment, as is required for acceptable container side-wall printing. In order to adjust the axial and cylindrical alignment of the indicia patterns, a printing head, herein referred to as a "Rutherford" printing head, has been provided in the past, and is removably mounted on the shaft head of the printing shaft. The shaft head, upon which the Rutherford printing head is mounted, has a right cylindrical outside surface. For mating therewith, the Rutherford printing head includes a single cylinder, having a right cylindrical inner wall, and a face plate/adjustment member. The face plate/adjustment member is adjustably attached to the cylinder, and the face plate is fixedly attached to the shaft head of the printing shaft. In order to adjust the axial alignment of the printing head, locking screws and adjusting screws are rotated to adjust the axial position of the cylinder with respect to the position of the printing shaft and the printing blanket. In order to adjust the cylindrical alignment of the printing head, separate locking screws are loosened, and an eccentric screw is rotated to adjust the cylindrical position of the cylinder with respect to the position of the printing shaft and the printing blanket. The locking screws are then tightened to maintain the cylindrical position.

A second type of decorator machine which has adjustable printing shafts, instead of having adjustable printing heads, for axial and cylindrical alignment of the printing heads thereon. One previous printing head which is used with this type of decorator machine is herein referred to as a "Concord" printing head. The Concord printing head is not adjustable for axial or cylindrical alignment. However, the Concord printing head, like the Rutherford printing head, is also removable from the shaft head of the printing shaft. The design for the connection used for mounting and removing the printing head onto/from the shaft head of the printing shaft is different from the Rutherford printing head. In particular, the shaft head of the printing head, has a tapered outside wall. This tapered outside wall, in combination with the cylindrical shape of the shaft head, creates a conical-like shape, only with the cone of the conical shape cut off at the top of the conic shape, leaving a flat vertical top of the shaft head, since the shafts are positioned horizontally. The single cylinder of the Concord printing head also has a tapered interior wall which forms a conical-like shape (also with the cone of the conical shape cut off, leaving a flat vertical wall in the interior of the cylinder). The shape of the interior of the cylinder of the Concord printing head, therefore, aligns, mounts, and engages with the shaft head of the printing shaft in a commercially acceptable manner.

Removability of the printing heads is significant. Specifically, to change an overall indicia pattern, an operator need only change the printing heads. As mentioned above, each printing head has a particular decorator printing plate attached around a portion of the circumference of the printing head). In order to set up a new overall indicia pattern, an operator need only replace the removed printing heads with new printing heads having different printing plates attached thereto.

Referring back to the design of the "Rutherford" printing head, since the printing heads are removed and replaced for printing runs requiring different indicia patterns on the container side-walls, a problem has been encountered with the use of the Rutherford design. Specifically, when the Rutherford printing heads are removed and re-mounted a number of times, the right cylindrical inner wall of the cylinder begins to wear, and the small tolerances between the inner wall of the cylinder and the right cylindrical outside surface of the shaft head begin to increase. This increase in the tolerances creates a looser fit, and prevents accurate axial and cylindrical alignment, which is necessary to align the shaft head with the printing blanket. A locking pin is also provided for mounting the printing head onto the shaft head of the printing shaft. However, this locking pin also loosens with repeated removal and remounting of the printing head from/onto the shaft head.

The design of the Concord head, described above, alleviates this wearing (increase in tolerance/loosened fit) problem with the use of the tapered inner wall (conical-like shape) of the cylinder in combination with a tapered outside wall of the shaft head (conical-like shape) of the printing head for the second type of decorator machine. Specifically, the conical-like shape of the shaft head and inner wall of the cylinder align, mount, and engage very well with one another. More importantly, based on this conical-like shape, the problem of a loosened fit/increase in tolerances is alleviated.

Although the Concord printing head alleviates the problem of the loosened fit between the shaft head and the interior of the cylinder, the Concord printing head is not adjustable. Only the printing shaft, to which the Concord printing head is attached, is adjustable for axial and cylindrical alignment. Concord printing heads are, therefore, less commonly used for this and other reasons.

The present invention is provided to solve these and other problems.

SUMMARY OF THE INVENTION

The present invention provides a printing head for a decorator cylinder assembly. The printing head comprises an interior member or cylinder having a shaft bore and an outer side wall. The shaft bore has a tapered interior side wall. The printing head further comprises an exterior member or cylinder having an inner side wall and a decorator side wall. The exterior member at least partially encompasses the interior member. The outer side wall of the interior member abuts the inner side wall of the exterior member, and the exterior member is adjustably connected about the interior member. The exterior member is at least partially axially adjustable about the interior cylinder, and is at least partially rotatably adjustable about the interior cylinder. The printing head further comprises a face plate/adjustment member adjustably connected to the interior member and the exterior member. In one embodiment, the face plate/adjustment member of the printing head includes an interior plate and an exterior plate. The decorator cylinder assembly also includes a rotatable printing shaft with a tapered shaft head. The interior plate of the printing head includes a central retaining bore, and the tapered shaft head of the decorator cylinder assembly includes a central retaining hole. The printing head further comprises a central retaining bolt for insertion through the central retaining bore and for insertion into the central retaining hole for retaining and fastening the interior plate to the tapered shaft head.

An axial adjustment assembly is provided for axially adjusting the exterior member about the interior member. Specifically, an adjustment screw is provided for adjusting the axial position of the exterior member in relation to the interior member, and a jack screw is provided for maintaining the axial position of the exterior member in relation to the interior member once the axial position is adjusted.

A rotation adjustment assembly is also provided for rotatably adjusting the exterior member about the interior member. Specifically, a registration adjuster is provided for adjusting the rotation position of the exterior member in relation to the interior member, and a locking screw is provided for maintaining the rotation position of the exterior member in relation to the interior member once the rotation position is adjusted.

The two piece printing head of the present invention incorporates the advantages of using interior member having a shaft bore with a tapered interior side wall for connection with a tapered shaft head, while providing the capabilities of axial and rotational adjustment of the decorator side wall without having to adjust the printing shaft. Thus, the printing head of the present invention can be connected to decorator machines with or without adjustable printing shafts.

Other features and advantages of the invention will be apparent from the following specification taken in conjunction with the following drawing.

DETAILED DESCRIPTION

Figure 1:
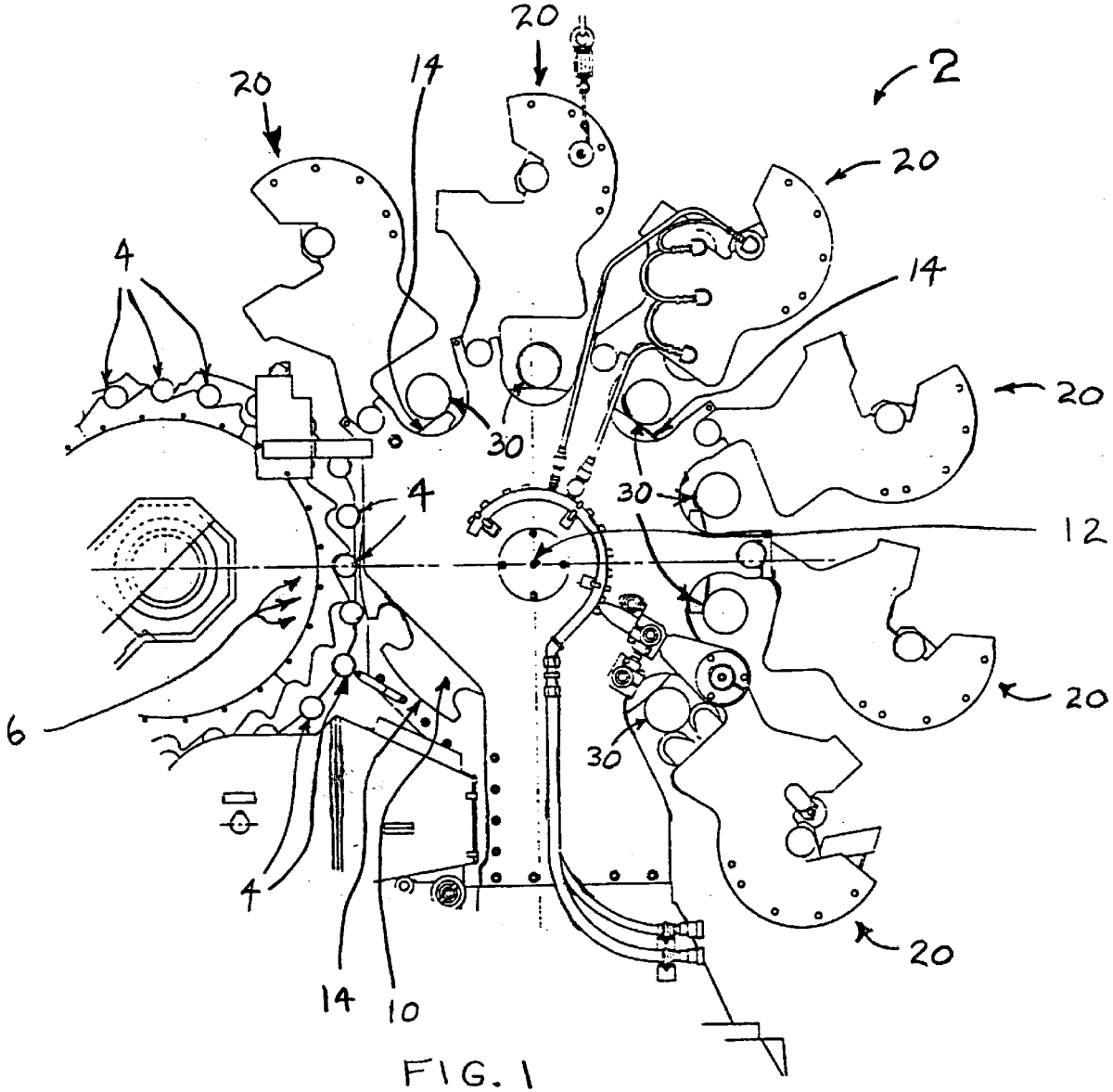
FIG. 1 is a partial side plan view of a decorator machine.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

Beverage containers 4 or cans are typically manufactured with indicia printed on the side (or side-wall) of the containers 4. These types of containers 4 are typically manufactured in two pieces. The first piece usually consists of a one-piece container bottom and container side-wall configuration. The second piece typically consists of the container top (or end) which is seamed to the first piece at the top of the side-wall, after some typical forming steps, such as necking, and after the beverage is poured into the first piece.

Before the forming steps, the pouring step, and before the second piece (container end) is seamed to the first piece, indicia is typically printed on at least a portion of the side-wall of the beverage container 4. The container 4 is usually positioned on its side for printing, as is shown in FIG. 1. The indicia is typically printed in many colors, as is well known. For example, printing the indicia onto a beverage container 4 typically includes printing background-like indicia onto a printing blanket 14 in one color, and then printing lettering onto the printing blanket 14 in areas which were not previously printed on, in another color (or in reverse order if the red is not behind the white). The image on the printing blanket 14 is then printed onto the side-wall of the container 4. Silver coloration is typically not required due to the silver color of the aluminum alloy; from which many containers 4 are made. Numerous other indicia, in numerous colors, can be printed onto a side-wall, via the printing blanket 14, as described below.

The printing of indicia onto the container side-wall is typically known as container decoration. A top view of part of a container decorator machine 2 is shown in FIG. 1. The container decorator machine 2 is used to print one or more colors onto a plurality of containers 4 for creating the indicia on the containers 4. The decorator machine 2 is well known in the art of container decoration. The decorator machine 2, shown in FIG. 1, comprises a printing blanket wheel 10, shown in more detail in FIG. 2, which rotates in a vertical plane about a central horizontal axis 12. The blanket wheel 10 includes a plurality of printing blankets 14, spaced at substantially equal intervals about the circumference of the blanket wheel 10. Each printing blanket 14 has a circumferential length 16 (the circumferential length between numeral 16*a* and 16*b* in FIG. 2). The length 16 of each printing blanket 14 generally corresponds to the circumference of the containers 4 for which the indicia will be printed, as will be explained in more detail below. Referring back to FIG. 1, the decorator machine 2 also comprises a plurality of inking stations 20. Each inking station 20 includes a decorator cylinder 30. Each decorator cylinder 30 includes a printing head, as further described below, with a decorator printing plate (not shown), and a printing shaft, as also further described below. A decorator printing plate is typically made from plastic, with a steel backing for magnetically attaching the decorator printing plate to the rest of the printing head. As such, the decorator cylinders 30 are commonly referred to as decorator magnetic cylinders in the art. Each decorator printing plate (not shown) provides an indicia pattern which represents at least a portion of the overall indicia pattern to be printed onto the container side-wall, as is well known. In particular, each decorator printing plate (not shown) provides part of the overall indicia pattern which pertains to the color of that inking station 20. Each inking station 20 also includes an assembly (not shown) for applying the ink onto the decorator printing plate of the decorator cylinder 30.

As described above, each inking station 20 of the decorator machine 2 from FIG. 1 is capable of printing one color of a particular indicia pattern, onto the printing blankets 14. Specifically, as the blanket wheel 10 rotates, the printing blankets 14 also rotate about the central horizontal axis 12, and pass by each of the inking stations 20. The inking stations 20 remain stationary.

Figure 2:
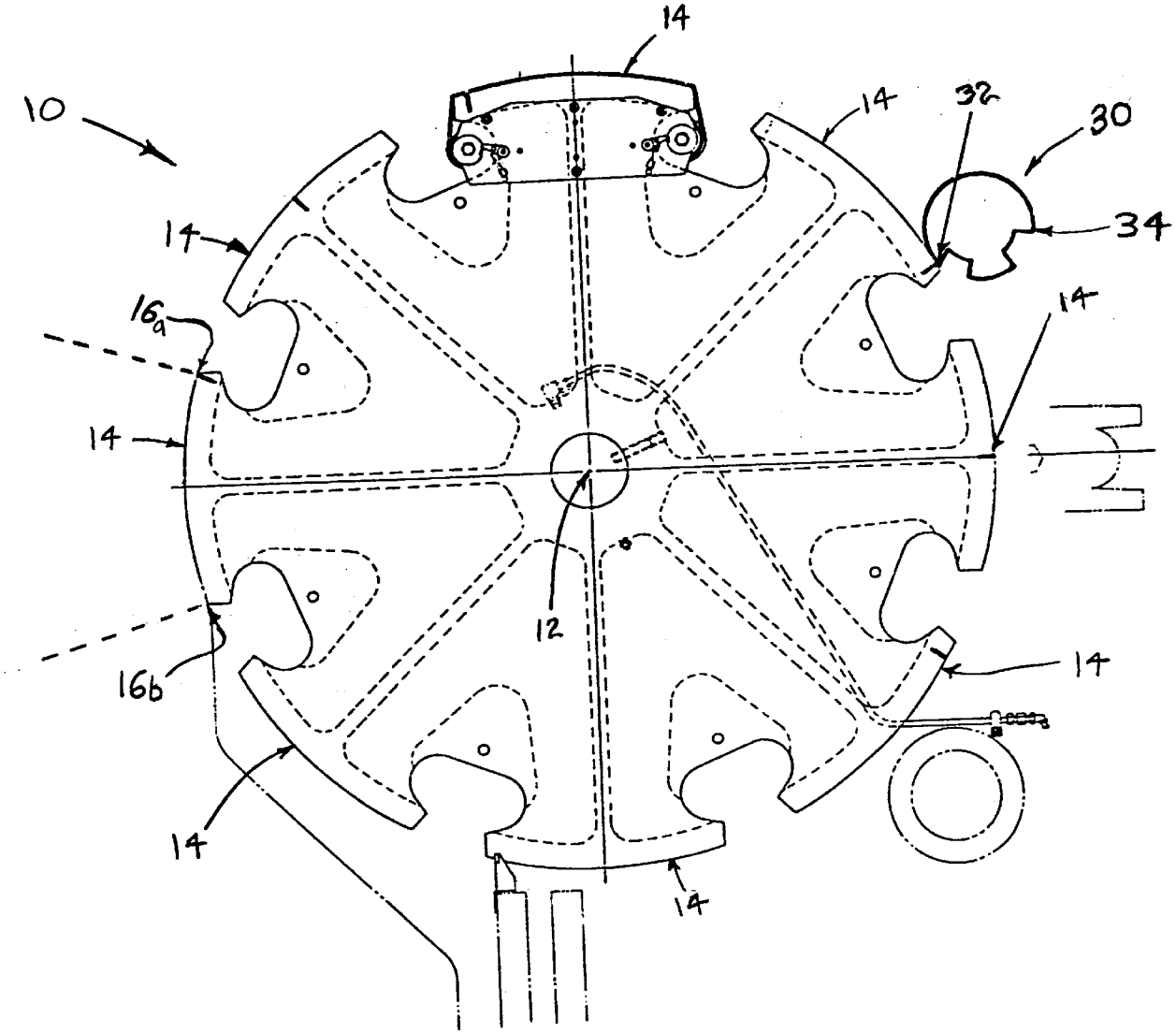
FIG. 2 is a side plan view of a blanket wheel of the decorator machine of FIG. 1.

Referring to both FIGS. 1 and 2, as each printing blanket 14 passes each inking station 20, the decorator printing plate, located around the circumference of the printing head of the decorator cylinder 30, comes onto contact with the printing blanket 14 at a beginning point 32 around the decorator printing plate which represents the beginning of the indicia pattern for that inking station 20. This occurs after ink is impressed onto the indicia pattern on the decorator printing plate. The ink on the indicia pattern on the decorator printing plate is then rolled onto the printing blanket 14, as the blanket wheel 10 rotates. As the blanket wheel 10 further rotates, the same printing blanket 14 comes out of contact with the decorator printing plate at an ending point 34 on the surface of the decorator printing plate, for the above mentioned inking station 20. The ending point 34 represents the end of the indicia pattern for that inking station 20. The particular printing blanket 14 being referred to above then engages the next decorator printing plate at the next inking station 20. A different ink color representing another portion of the overall indicia pattern is then printed onto the same printing blanket 14.

Once the same printing blanket 14 has passed each inking station 20, wherein the printing blanket 14 now has all of the colors for the overall indicia pattern printed onto the printing blanket 14, the printing blanket 14 then comes into contact with the side-wall of the container 4. As the printing blanket 14 further rotates around the central axis 12, the overall indicia pattern impresses and prints onto the side-wall of the container 4 at side-wall print region 6 (FIG. 1). The container 4 is caused to rotate about its central axis to accommodate the printing process. The length of the overall indicia pattern, between the beginning point 32 and the ending point 34, is typically a few millimeters longer than the circumference of the side-wall of the container 4, thereby causing a vertical overlap region to be created during printing. This overlap region provides assurance that the beginning of the overall indicia pattern meets with the end of the overall indicia pattern.

With the use of the decorator machine 2, for printing indicia patterns onto the side-walls of containers 4, comes several difficulties. Considerations in the design of this type of decorator machine 2 include aligning the several portions (colors from each inking station 20) of the overall pattern with one another before the overall indicia pattern is printed onto the container side-wall, as well as aligning the overall indicia pattern with the container side-wall. These and other alignment concerns have been addressed in the past with the use of an adjustable printing head, and as an alternative with the use of an adjustable printing shaft.

Figure 4:
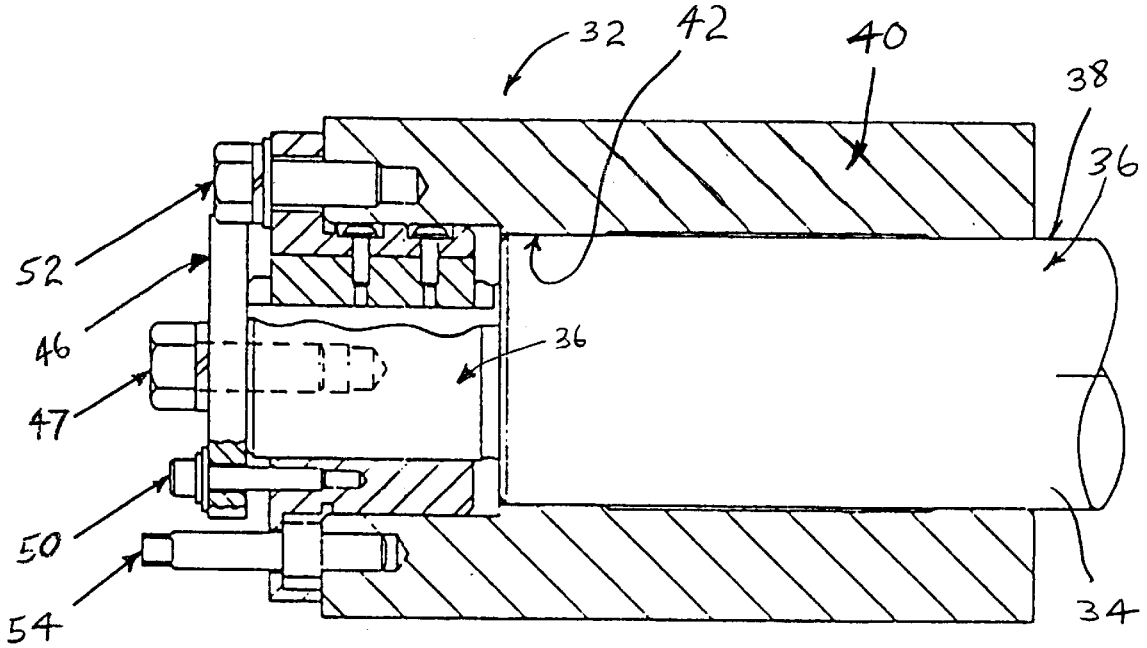
FIG. 4 is a cross sectional side plan view of the Rutherford type printing head from FIG. 3.
Figure 3:
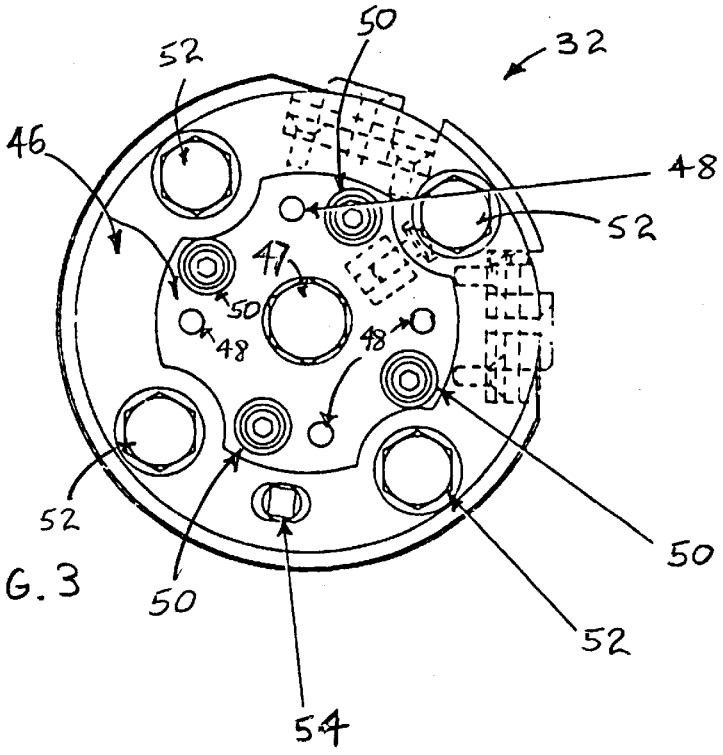
FIG. 3 is front view of a "Rutherford" type printing head.

Referring to FIGS. 1, 3 and 4, a first type of decorator machine 2 includes a decorator cylinder assembly 30 having a printing head 32 which is removably attached to a rotatable printing shaft 34. The rotation of the printing shaft 34 causes the printing head 32, mounted thereon, to rotate therewith.

The printing shafts 34 are oriented in a horizontal fashion within the decorator machine 2 and, rotate about a plurality horizontal axes, which go through the center of the decorator cylinders 30. However, in this first type of decorator machine 2, the printing shaft 34 is not adjustable for the axial or cylindrical alignment of the printing head, and thus, of the indicia patterns, as is required for acceptable container side-wall printing. The axial and cylindrical alignment is sometimes referred to as the registration of the printing head. In order to adjust the axial and cylindrical alignment of the indicia patterns, the printing head 32 in FIGS. 3 and 4, herein referred to as a "Rutherford" printing head 32, has been provided in the past, and is removably mounted on top of a shaft head 36 of the printing shaft 34. The shaft head 36, upon which the Rutherford printing head 32 is mounted, has a right cylindrical outside surface 38. For mating therewith, the Rutherford printing head 32 includes a single cylinder member 40, having a right cylindrical inner wall 42, and a face plate/adjustment member 46. The face plate/adjustment member 46 is adjustably attached to the cylinder member 40 for cylindrical and axial adjustment, and the face plate/adjustment member 46 is fixedly attached to the shaft head 36 of the printing shaft 34 with a bolt 47. In order to adjust the axial alignment (movement back and forth along the horizontal axis of the printing shaft) of the printing head 32, locking screws 48 and adjusting screws 50 are rotated in different directions, depending on the axial movement required, to adjust the axial position of the cylinder member 40 with respect to the position of the printing shaft 34 and printing blanket 14. In order to adjust the cylindrical alignment (rotational position about the horizontal printing shaft axis) of the printing head 32, locking screws 52 are loosened, and an eccentric screw 54 is rotated to adjust the cylindrical position of the cylinder member 40 with respect to the position of the printing shaft 34. The locking screws 52 are then tightened to maintain the cylindrical position of the printing head 32.

Figure 5:
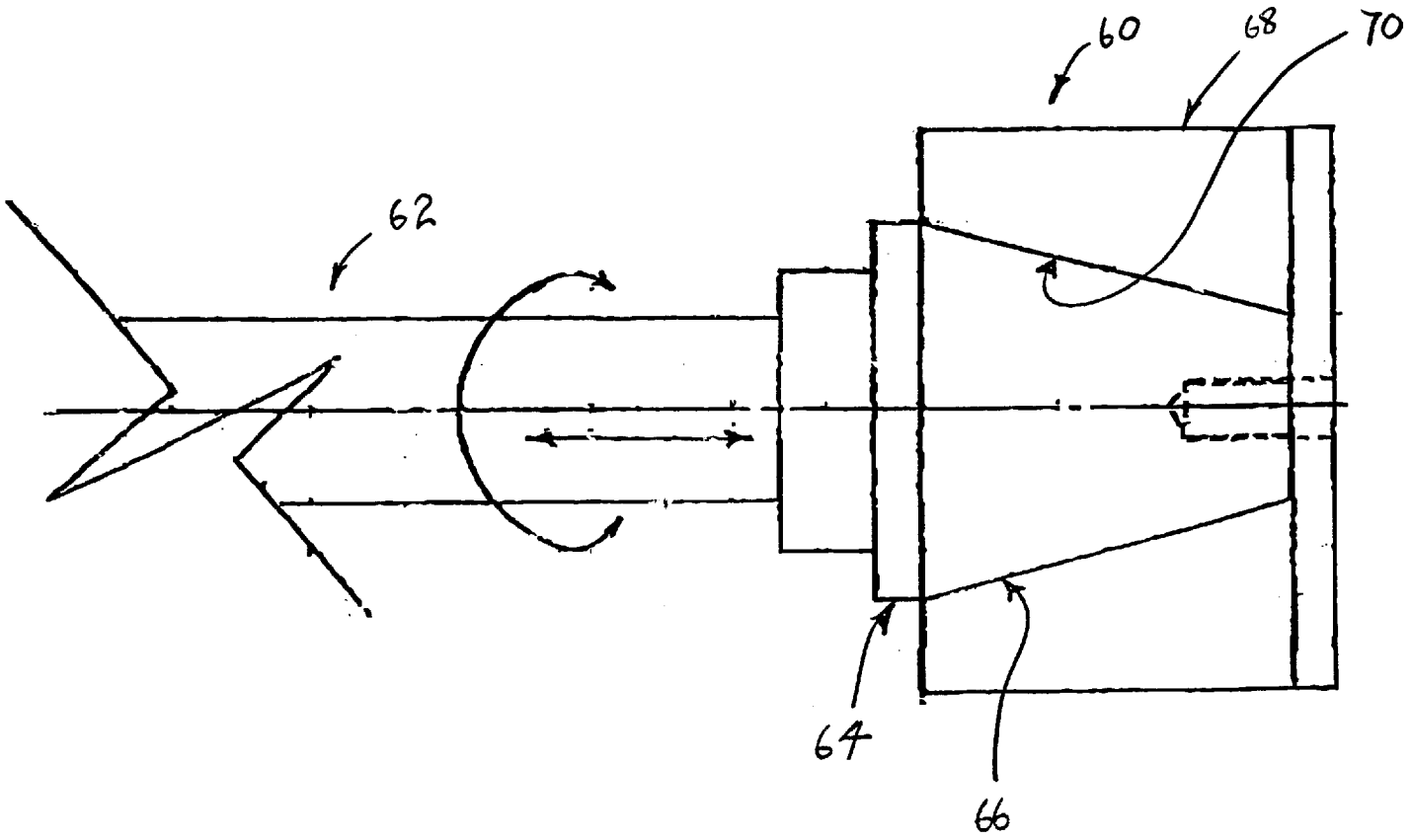
FIG. 5 is a side plan view of a "Concord" type printing head.
Figure 7:
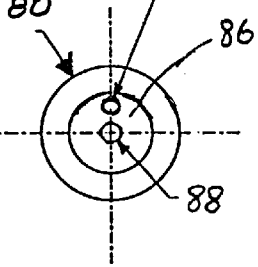
FIG. 7 is a front plan view of the printing shaft from FIG. 6.
Figure 6:
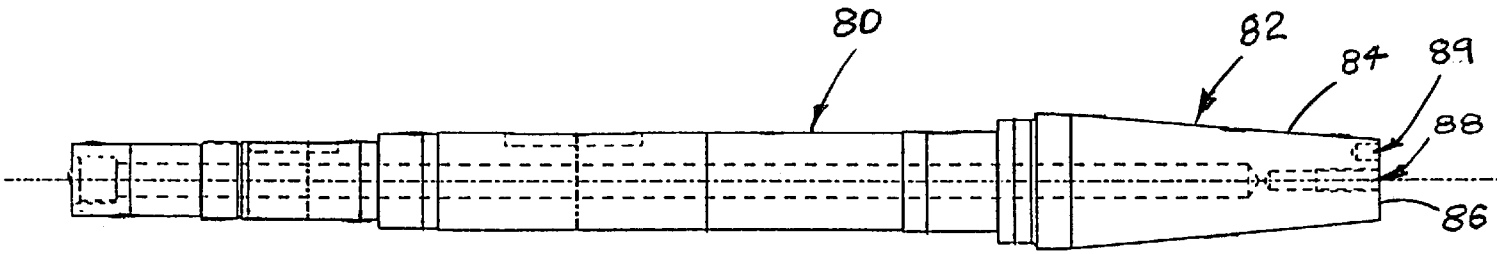
FIG. 6 is a side plan view of a printing shaft of the present invention.
Figure 9:
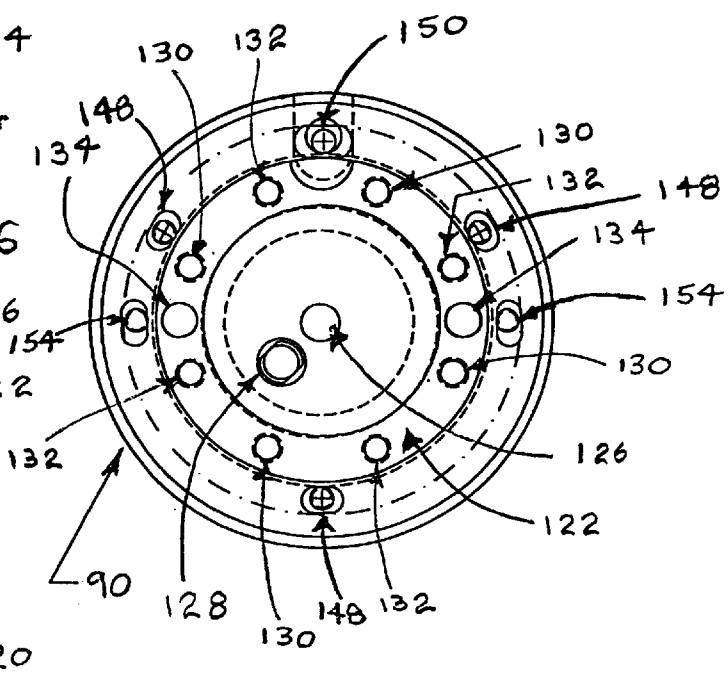
FIG. 9 is front plan view of the printing head of FIG. 8.

Referring now to FIGS. 1 and 5, as mentioned above, there is second type of decorator machine 2 which has adjustable printing shafts, instead of having adjustable printing heads, for axial and cylindrical alignment. In particular, one previous printing head which is used with this type of decorator machine is herein referred to as a "Concord" printing head 60, built by Ragsdale of Denver, Colo. In contrast to the Rutherford printing head 32, the Concord printing head 60 is not adjustable for axial or cylindrical alignment with respect to the rotatable printing shaft 34. However, the Concord printing head 60, like the Rutherford printing head 32, is removable from a Concord shaft head 64 of a Concord printing shaft 62. The design for the connection used for mounting and removing the Concord printing head 60 onto/from the shaft head 64 of the printing shaft 62 is different from the Rutherford printing head 32. In particular, the shaft head 64 of the printing shaft 62, has a tapered outside wall 66. This tapered outside wall 66, in combination with the cylindrical shape of the shaft head 64, creates a conical-like shape, only with the cone of the conical shape cut off, leaving a flat vertical front of the shaft head 64 (shown in a side view in FIG. 5). Like the Rutherford printing head 32, the Concord printing head 60 includes a single cylinder member 68. The cylinder member 68 of the Concord printing head 60 has a tapered interior wall 70 which also forms a conical-like shape (also with the cone of the conical shape cut off, leaving a flat vertical front of the interior of the cylinder 68). The shape of the interior of the cylinder 68 of the Concord printing head 60, therefore, aligns, mounts, and engages with the shaft head 64 of the printing shaft 62 in a commercially acceptable manner.

Removability of printing heads generally is significant. Specifically, to change an overall indicia pattern, an operator need only change the printing heads within the decorator machine 2. As a mentioned above, each printing head in the decorator machine 2 has a particular decorator printing plate attached around a portion of the circumference of the printing head. In order to set up a new overall indicia pattern, an operator need only replace the removed printing heads with new printing heads having different printing plates attached thereto.

Referring to FIGS. 3 and 4, since the Rutherford printing heads 32 are removed and replaced for printing runs requiring different indicia patterns on the container side-walls, a problem has been encountered with the use of the Rutherford design. Specifically, when the Rutherford printing heads are removed and re-mounted a number of times, the right cylindrical inner wall 42 of the cylinder member 40 begins to wear, and the small tolerances between the inner wall 42 of the cylinder member 40 and the right cylindrical outside surface 38 of the shaft head 36 begin to increase. This increase in the tolerances creates a looser fit between the Rutherford printing head 32 and the shaft head 36 of the printing shaft 34, and prevents accurate axial and cylindrical alignment or registration, which is necessary to align the Rutherford printing head 32 with the printing blanket 14. A locking pin (not shown) is also provided for mounting the Rutherford printing head 32 onto the shaft head 36 of the printing shaft 34. As with the tolerances, this locking pin also loosens with repeated removal and re-mounting of the Rutherford printing head 32 from/onto the shaft head 36.

Referring to FIG. 5, the design of the Concord printing head 60, described above, alleviates this wearing (increase in tolerance/loosened fit) problem with the use of the tapered inner wall 70 (conical-like shape) of the cylinder member 68 in combination with a tapered outside wall 66 of the shaft head 64 (conical-like shape) of the printing shaft 62 for the second type of decorator machine 2. Specifically, the conical-like shape of the shaft head 64 and inner wall 70 of the cylinder member 68 engage in a tight fit which does not change from repeatedly removing and replacing the Concord printing head 70. More importantly, based on this conical-like shape, the problem of a loosened fit/increase in tolerances is alleviated.

Although the Concord printing head 60 alleviates the problem of the loosened fit between the shaft head and the interior of the cylinder, the Concord printing head 60 is not adjustable with respect to the printing shaft 62. Instead, the printing shaft 62, to which the Concord printing head 60 is attached, is adjustable for axial and cylindrical alignment. In particular, the printing shaft 62 used in connection with a Concord printing head 60 is connected to a helical gear which, after the printing shaft 62 is unlocked, is used for adjusting the rotation position of the printing shaft 62. The axial position of the Concord printing head 60 is adjusted by unlocking the printing shaft 62 and axially moving the printing shaft along the helical gear. Using a helical gear to drive the shaft 62 provides a longer lasting drive connection with the shaft 62, and a tighter fit, as well. However, each and every time the Concord printing head 60 is in need of adjustment, the printing shaft 62 must be unlocked. The present invention significantly improves upon the problems and shortfalls of the previously described and other printing heads, and provides, at least, ease of use, better print quality, better longevity of the printing head, and better registration of the individual station indicia patterns, and thus, the overall indicia pattern.

Referring to FIGS. 1–2 and 6–9, a tapered printing shaft 80 of the present invention is shown in and is used within the decorator machine 2 to support, rotate with, and mount with an improved printing head 90. The tapered printing shaft 80 has a tapered shaft head 82 with a tapered outside wall or surface 84. The tapered shaft head 82 is generally in a conical shape with the point of the conical shape cut off, thereby creating a shaft head top 86. The printing shaft 80 also has a central retaining bore 88 and a jack hole 89 (not shown in FIG. 8).

Figure 13:
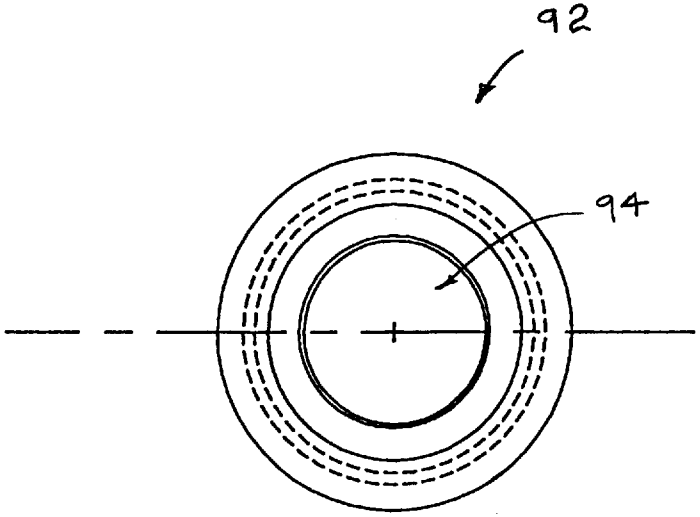
FIG. 13 is a front plan view of the interior member from FIG. 12.
Figure 12:
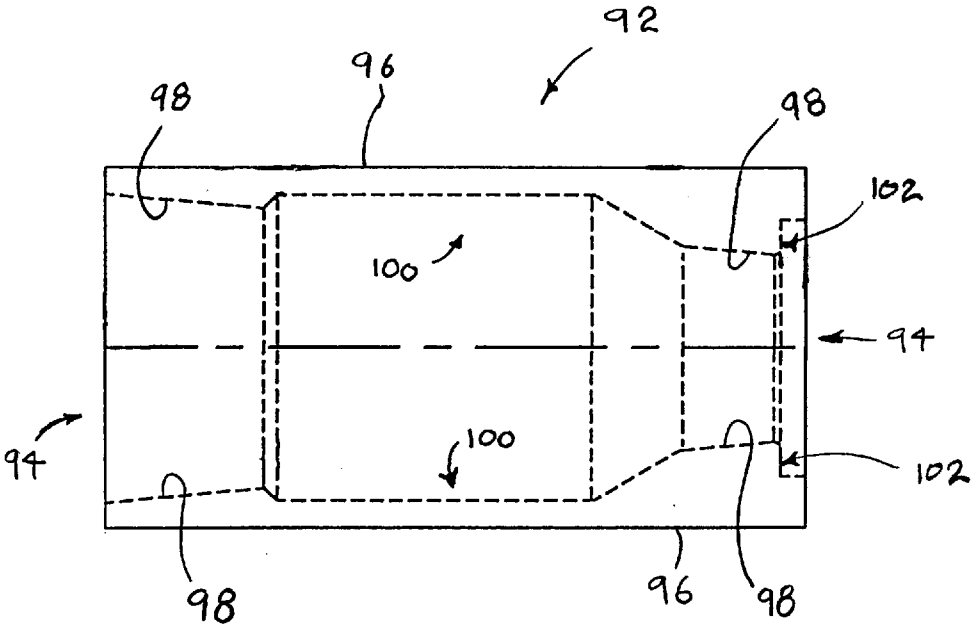
FIG. 12 is a side plan view of an interior member of the printing head of FIG. 8.
Figure 15:
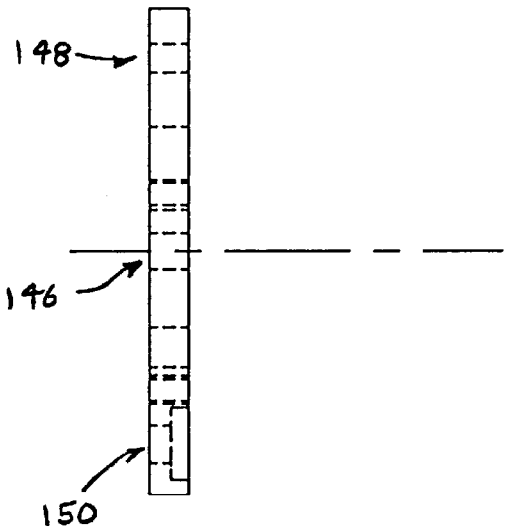
FIG. 15 is a side plan view of the exterior plate from FIG. 14.
Figure 14:
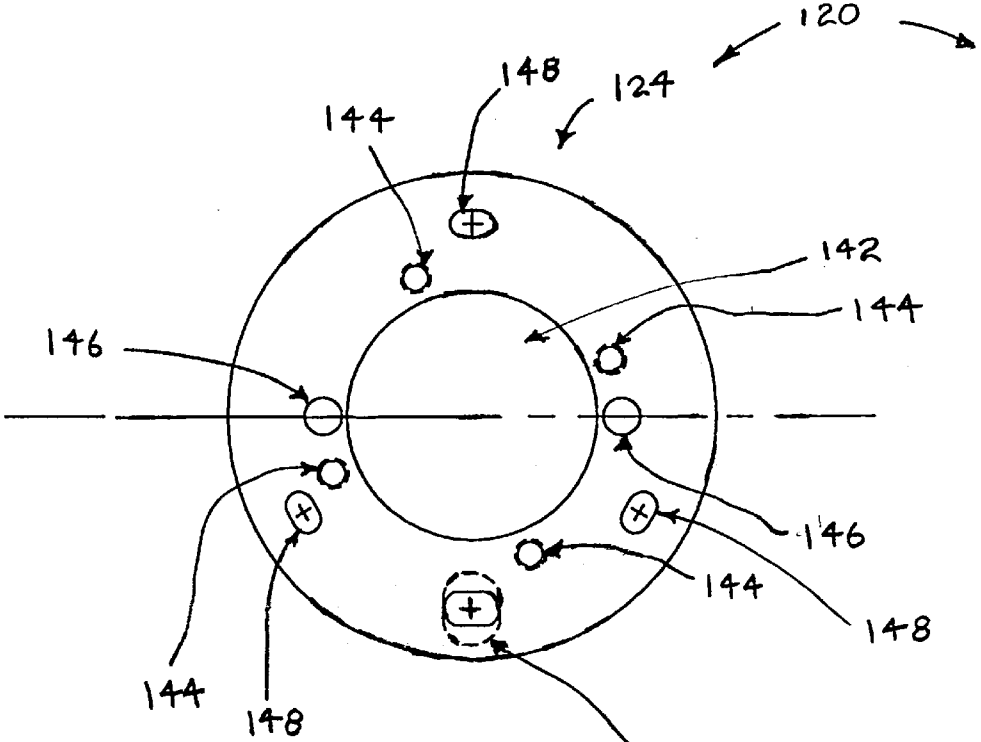
FIG. 14 is a front plan view of an exterior plate of the face plate/adjustment member from the printing head of FIG. 8.
Figure 17:
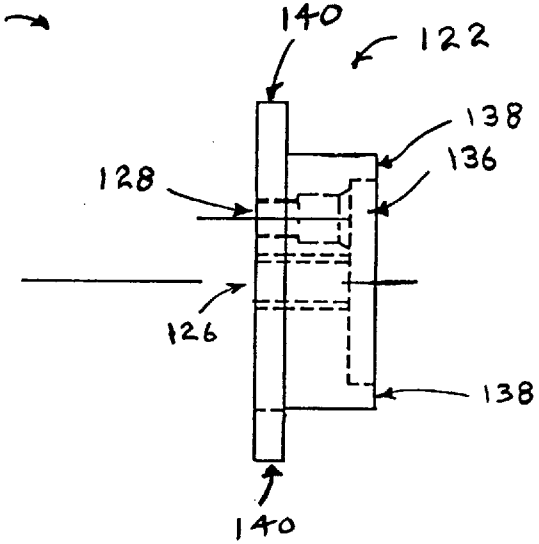
FIG. 17 is a side plan view of the interior plate from FIG. 16.
Figure 16:
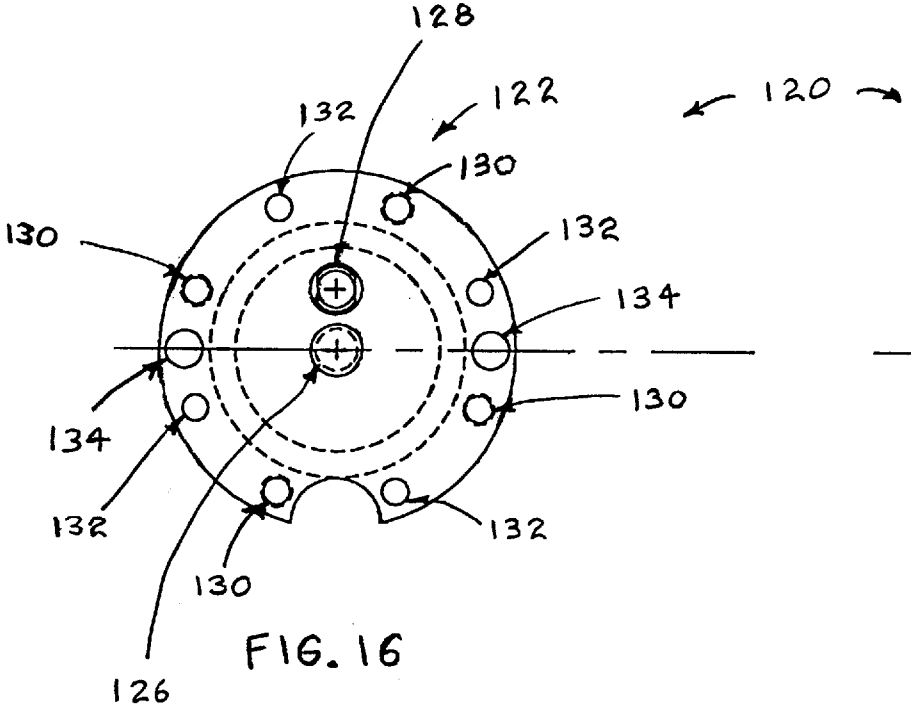
FIG. 16 is a front plan view of an interior plate of the face plate/adjustment member from the printing head of FIG. 8.

The printing head 90 is a part of a decorator cylinder assembly 30 (FIG. 1), as generally mentioned above. The printing head 90 comprises a first or interior member 92, which can take the shape of a cylinder (interior cylinder 92, as shown in FIGS. 12 and 13), having a shaft bore 94 and an outer side wall 96. The outer side wall 96 can have a shape of a generally cylindrical surface. The shaft bore 94 has a tapered interior side wall 98. The shaft bore in FIGS. 8 and 12, which includes and creates the interior side wall 98, also includes an interior relief area 100, shown in FIG. 8 with shading. The relief area 100, and other relief areas, lighten the overall printing head 90 weight. The interior member also includes a face plate/adjustment member abutment 102, as will be discussed below.

Figure 8:
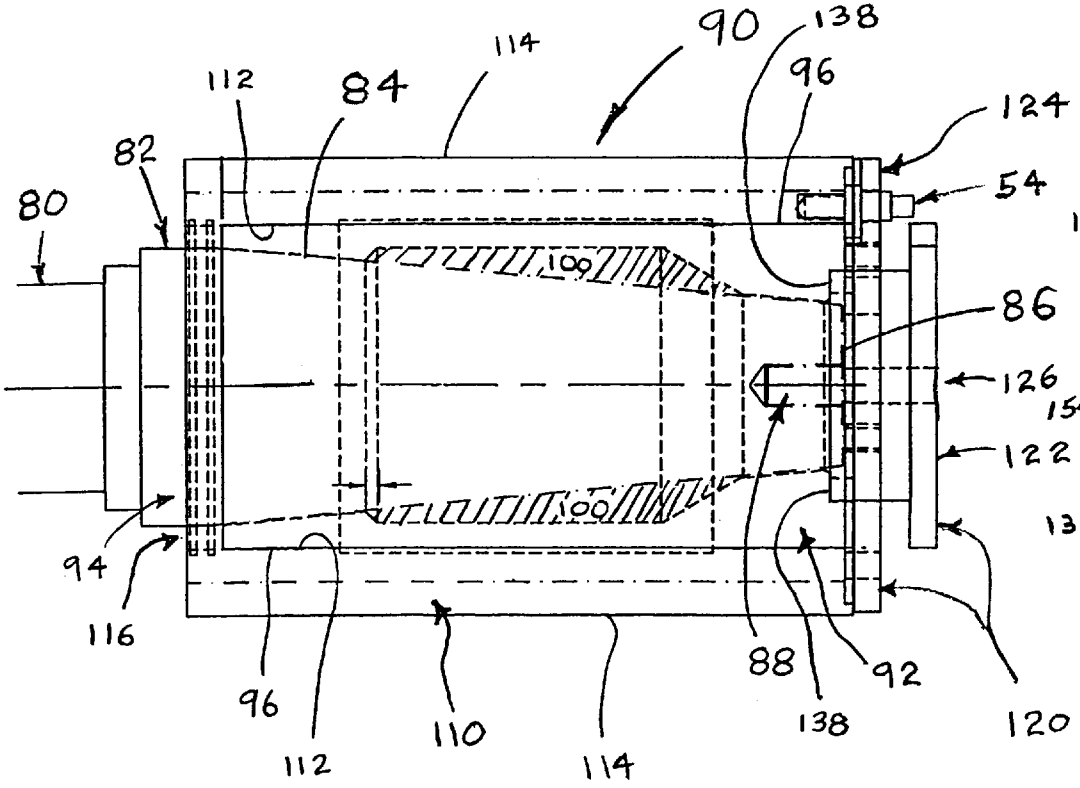
FIG. 8 is a side plan view of a printing head of the present invention, mounted on the printing shaft.
Figure 11:
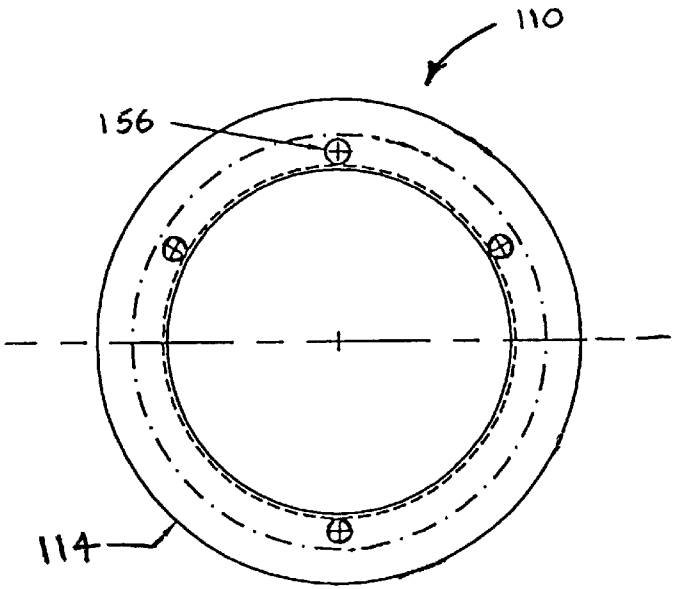
FIG. 11 is a front plan view of the exterior member from FIG. 10.
Figure 10:
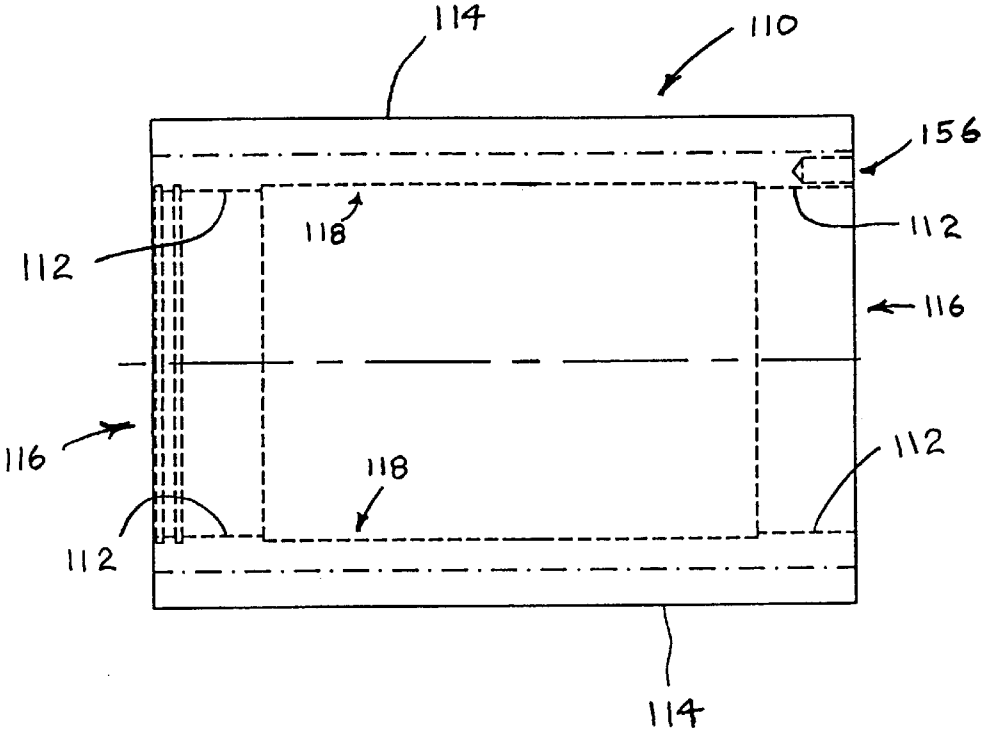
FIG. 10 is a side plan view of an exterior member of the printing head of FIG. 8.

The printing head 90 further comprises a second or exterior member 110, as shown in FIGS. 10 and 11. The exterior member 110 includes an interior bore 116 having an inner side wall 112. An inner relief area 118 is also provided within the interior bore 116. Specifically, the inner side wall 112 of the exterior member 110 includes the inner relief area 118 within the interior bore 116. The exterior member 110 further includes a decorator side wall 114. The decorator side wall 114 has a generally cylindrical surface. As shown in FIG. 8, by reference to FIGS. 10 and 12, the exterior member 110 at least partially encompasses the interior member 92. Specifically, the interior member 92 is inserted within the exterior member 110 with the exterior member 110 encompassing the interior member 92.

The tapered interior side wall 98 of the interior member 92 is provided for accepting and fixedly engaging the tapered shaft head 82, and the interior member 92 is rotatable with the tapered printing shaft 80. In addition, the exterior member 110 at least partially circumscribes the interior member 92. As will be described further below, the exterior member 110 is axially and rotatably adjustable about the interior cylinder 92.

Referring also to FIGS. 14–19, the printing head 90 further comprises a face plate/adjustment member 120. The face plate/adjustment member 120 is adjustably connected to the interior member 92 and the exterior member 110, as will be described further below. The face plate/adjustment member 120 of the printing head 90 shown in FIG. 8 includes an interior plate 122 and an exterior plate 124. A plurality of connection pieces are provided within the printing head 90 for connecting the interior plate 122 to the tapered shaft head 82 and to the interior member 92. The connection pieces are also provided for connecting the interior plate 122 to the exterior plate 124, and for connecting the exterior plate 124 to the exterior member 110.

The exterior plate 124 is axially adjustable with respect to the interior plate 122. This adjustment allows the exterior member 110 to be axially adjustable about the interior member 92. Axial adjustment need only take place in small measurements (partial adjustment) for alignment of the indicia onto the container 4. Further, the exterior plate 124 is rotatably or cylindrically adjustable with respect to the exterior member 110. This adjustment allows the exterior member 110 to be rotatably adjustable about the interior member 92. Rotation adjustment also need only take place in small measurements (partial adjustment) for alignment of the indicia onto the container 4. Adjustment usually takes with the assistance of look-through magnification inspection glasses. The axial adjustments can be made from, at least, in a range between 0 and 5/16 inches, and the indicia is typically positioned between 3/32 and 5/32 inches from the top of the container 4. The rotational or cylindrical adjustments can be made from, at least, in a range between 0/10000 and 110/10000 inches. A Butt fit between colors, with no metallic alloy silver between the colors, can be achieved with the present invention.

The interior plate 122 includes a central retaining bore 126, a jack bore 128, a plurality of tension bores 130, a plurality of adjustment bores 132, a plurality of alignment bores 134, a shaft head recess 136, a interior member abutment 138, and an interior plate lip 140. The exterior plate 124 includes an interior plate bore 142, a plurality of adjustment bores 144, a plurality of alignment bores 146, a plurality of shoulder bores 148, and an eccentric bore 150.

The printing head 90 further comprises a central retaining bolt 160, a jack screw 162, a plurality of adjustment screws 164, a plurality of tensions screws 166, a plurality of alignment dowels 168, a plurality of shoulder bolts 170, and a plurality of locking screws 172. (See FIG. 8 and FIG. 20).

The printing head embodiment shown in FIG. 8 is further assembled as follows. Specifically, tapered shaft head 82 is inserted into the interior member 92, and the interior member 92 is inserted into the exterior member 110. The exterior plate 124 is mounted onto the exterior member 110 and the interior plate 122 is inserted into the interior plate bore 142 with the interior plate lip protruding outwardly from the central retaining bore 126 within the interior plate 122. The interior member abutment 138 of the interior plate 122 abuts the face plate/adjustment member abutment 102 of the interior member 92. Therefore, as shown in FIG. 8, the shaft head top 86 is inserted into the shaft head recess 136 within the interior plate 122.

The central retaining bolt 160 is inserted through the central retaining bore 126 of the interior plate 122, and inserted into the central retaining hole 88 of the tapered shaft head 82, for retaining and fastening the interior plate 122 to the tapered shaft head 82. This central retaining bolt 160 insertion also maintains the interior member abutment 138 of the interior plate 122 abutted to the face plate/adjustment member abutment 102 of the interior member 92. The jack screw 162 is inserted through the jack bore 128 of the interior plate 122 and into the jack hole 89 of the tapered shaft head 82. This jack screw 162 insertion locks the above mentioned central retaining bolt 160 connection. Therefore, the jack screw 162 assists in maintaining the axial position of the interior member 92 in relation to the exterior member 110. The plurality of alignment dowels 168 are inserted through the alignment bores 134 within the interior plate 122 and into the alignment holes 146 within the exterior plate 124 for maintaining rotational/cylindrical alignment between the interior plate 122 and the exterior plate 124. The plurality of adjustment screws 164 are inserted through adjustment bores 132 within the interior plate 122 and into the adjustment holes 144 within the exterior plate 124. The adjustment screws 164 are provided for adjusting the axial position of the interior member 92 in relation to the exterior member 110, as will be further described below.

The plurality of tensions screws 166 are inserted through the tension bores 130 for maintaining the adjustment made with the adjustment screws 164. Specifically, when the axial alignment needs to be corrected, depending on the direction of correction, the tension screws 166 are loosened, the adjustment screws 164 are rotated in the appropriate direction, and the tension screws 166 are then tightened again for maintaining the adjustment. These connections are provided for axially adjusting the exterior member 110 about the interior member 92, as can be further understood by reference to the Figures.

The plurality of shoulder bolts 170 are inserted through shoulder bores 154, and into the exterior member 110. The shoulder bolts are provided for both locking the exterior plate 124 to the exterior member 110, and for limiting the indexing or rotation/cylindrical adjustment. Likewise, the plurality of locking screws 172 are inserted through locking bores 148 and into the exterior member 110. The locking screws 172 are provided for, at least, locking the exterior plate 124 to the exterior member 110, after rotation adjustment, and for, thus, maintaining the rotational position of the interior member 92 in relation to the exterior member 110.

Figure 19:
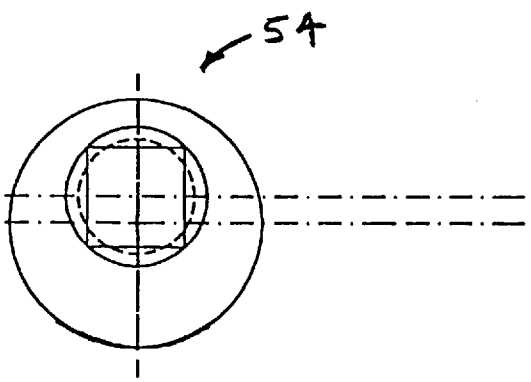
FIG. 19 is a front plan view of the eccentric from FIG. 18.
Figure 18:
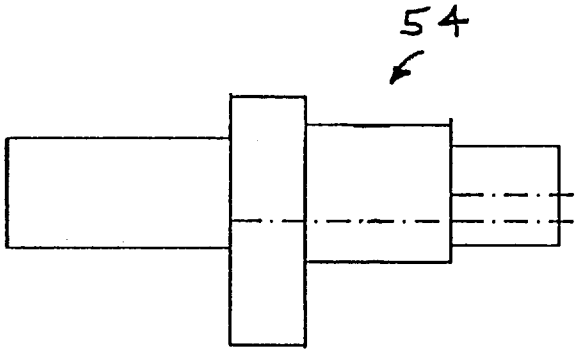
FIG. 18 is a side plan view of an eccentric from the printing head of FIG. 8.

Referring now to FIGS. 18 and 19, for the embodiment generally shown in FIG. 8, the eccentric 54 is shown in more detail. The eccentric 54 is inserted through the eccentric bore 150 within the exterior plate 124, and into an eccentric hole 156 within the exterior member 110. Rotational/cylindrical adjustment is performed as follows. The shoulder bolts 170 and the locking screws 172 are loosened, the eccentric is rotated either clockwise or counter-clockwise, depending on the rotation adjustment correction required, which causes the exterior member 110 to move rotationally with respect to the interior member 92. The shoulder bolts 170 and the locking screws 172 are then tightened to maintain the rotational position. The previous connections are provided for rotatably adjusting the exterior member 110 about the interior member 92, and the face plate/adjustment member 120 is adjustment connected to the interior member 92 and the exterior member 110.

Referring to FIGS. 20–31, with reference to the previous Figures, a separate embodiment is provided which includes a separate assembly for rotational/cylindrical adjustment. Specifically, the printing head 90, in FIG. 20 comprises a rotational adjustment assembly. The rotational adjustment assembly includes a pull dowel 180, a pivot 182, and a registration adjuster 184. A cut out 178 is provided within the exterior plate 124 for access to the registration adjuster 184. An index 186 is also provided within the exterior plate 124. The exterior member 110 of the embodiment further includes a pull dowel hole 188, and the pivot includes a pivot dowel hole 190 and a registration adjuster hole 192. The registration adjuster 184 also includes a ball head 194.

One end of the pull dowel 180 is inserted into the pull dowel hole 188 and the pivot 182 is inserted onto the other end of the pull dowel 180, and the other end of the pull dowel 180 is inserted into the pivot dowel hole 190. One end of the registration adjuster 184 is inserted into the registration adjuster hole 192 within the pivot 182. The other end, or ball head 194, of the registration adjuster 184 is fitted within a ball head region 196 within the exterior plate 124, shown in FIGS. 23 and 25. The exterior plate also includes a pivot region 196 for accepting the pivot 182. When the exterior plate 124 is mounted onto the exterior member 110, the pivot region 198 and ball head region 196 mounts onto and fits around (captures) the pivot 182 and ball head 194, respectively. In order to adjust the rotational/cylindrical position of the exterior member 110 about, and with respect to, the interior member 92, the shoulder bolts 170 and the locking screws 172 are loosened, the rotation adjuster is rotated in either one or the other direction, depending on the rotational adjustment correction required, and the shoulder bolts 170 and the locking screws 172 are then tightened to maintain the rotation position of the interior member 92 in relation to the exterior member 110, once the rotation position is adjusted. The pull dowel 180, thus, pivotally connects the pivot 182 to the exterior member 110, and the registration adjuster adjustably connects the pivot 182 to the face plate/adjustment member 120 for adjusting the rotation position of the interior member 92 in relation to the exterior member 110.

Figure 20:
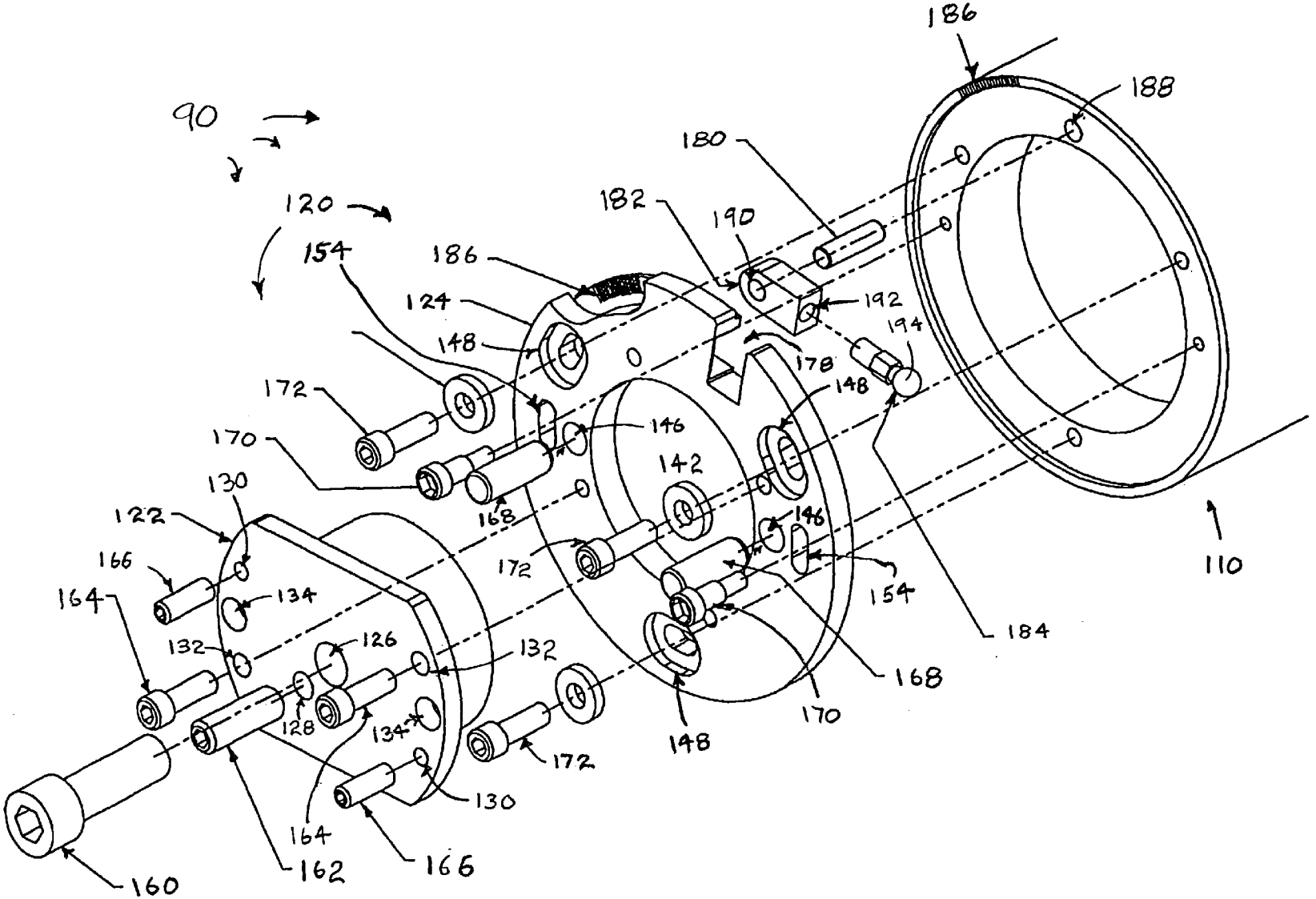
FIG. 20 is a exploded perspective view of an alternative printing head embodiment of the present.
Figure 21:
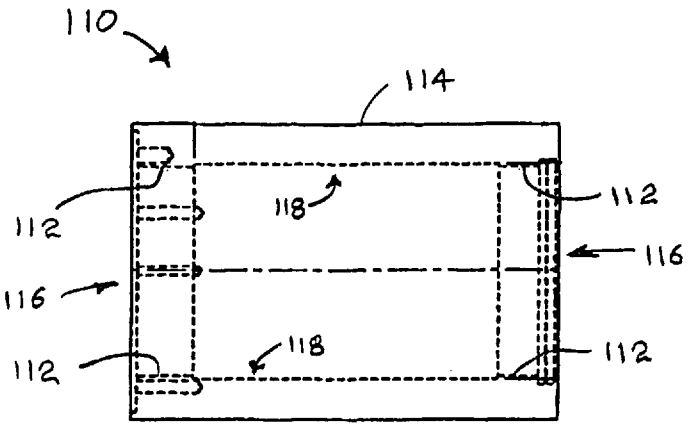
FIG. 21 is a side plan view of an exterior member of the printing head of FIG. 20.
Figure 22:
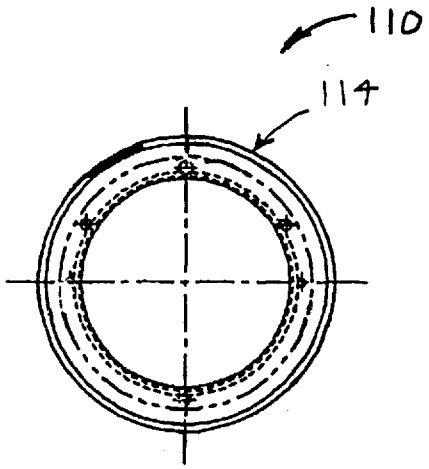
FIG. 22 is a front plan view of the exterior member from FIG. 21.
Figures 23, 24, 25:
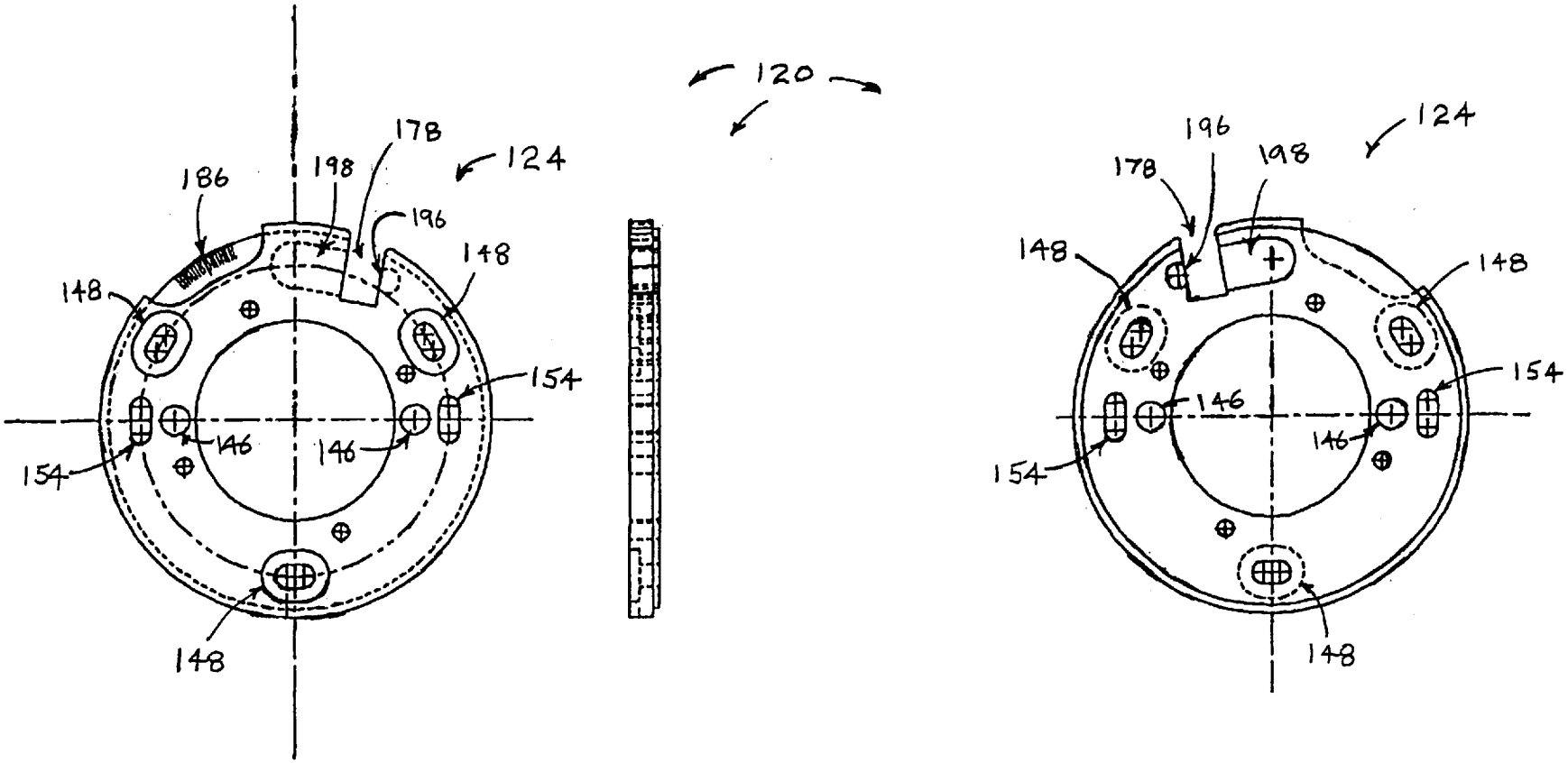
FIG. 23 is a front plan view of an exterior plate of the printing head of FIG. 20.
FIG. 24 is a side plan view of the exterior plate from FIG. 23.
FIG. 25 is a reverse plan view of the exterior plate from FIG. 23.
Figure 27:
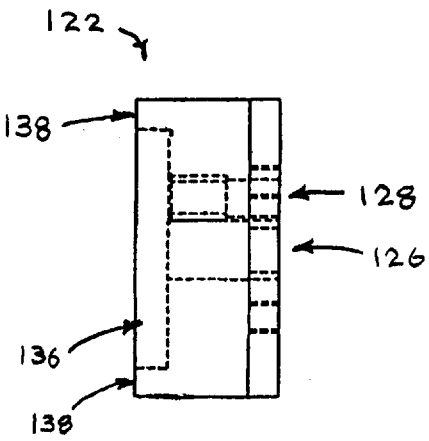
FIG. 27 is a side plan view of the interior plate from FIG. 26.
Figure 26:
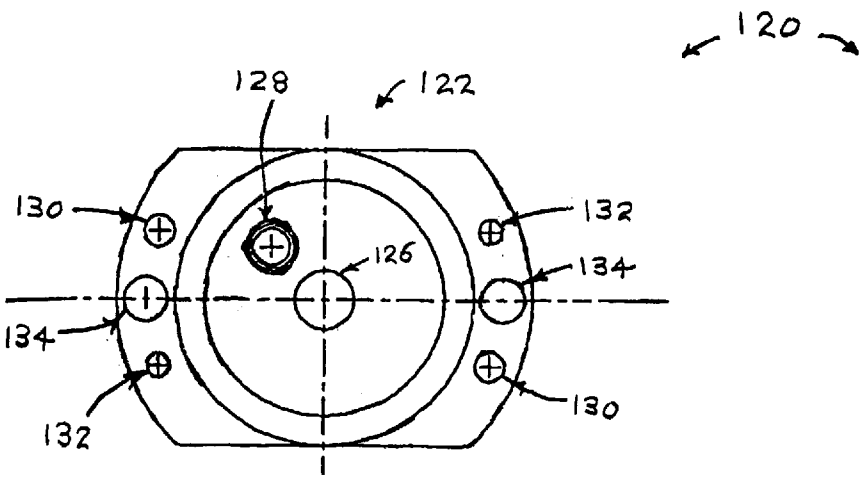
FIG. 26 is a front plan view of an interior plate of the printing head of FIG. 20.
Figure 28:
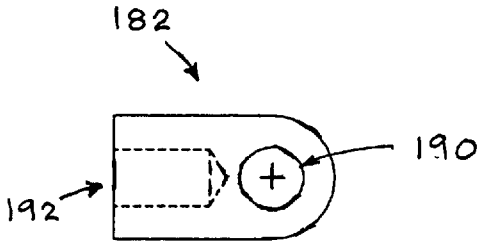
FIG. 28 is front plan view of a pivot of the printing head of FIG. 20.
Figure 29:
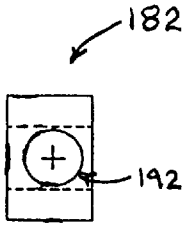
FIG. 29 is a side plan view of the pivot from FIG. 28.
Figure 30:
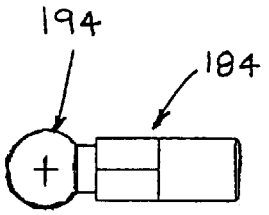
FIG. 30 is front plan view of a registration adjuster of the printing head of FIG. 20.
Figure 31:
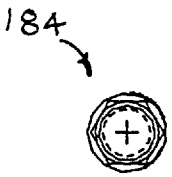
FIG. 31 is a side plan view of the registration adjuster from FIG. 28.
Figure 1:
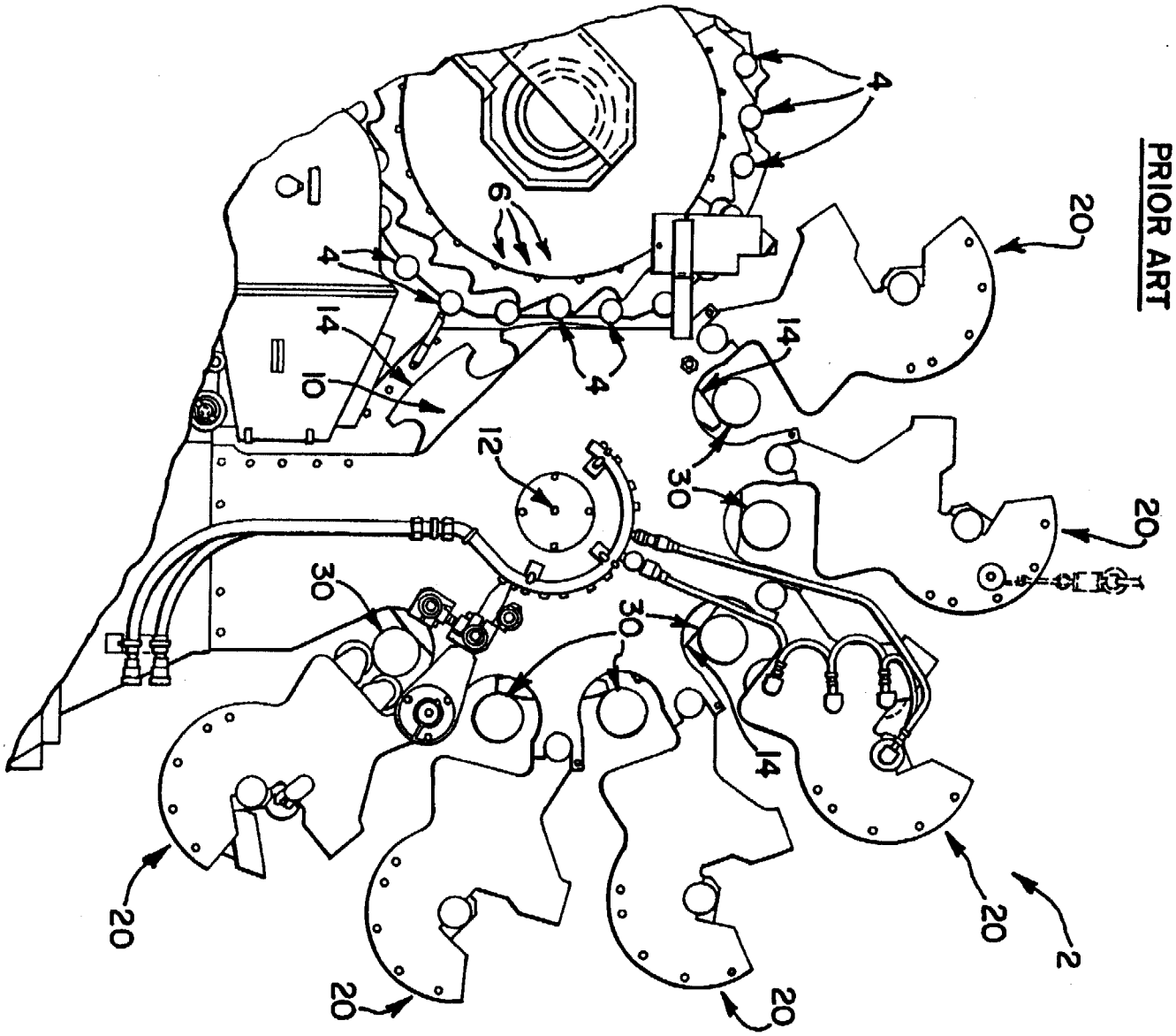
FIG. 1 PRIOR ART
Figure 2:
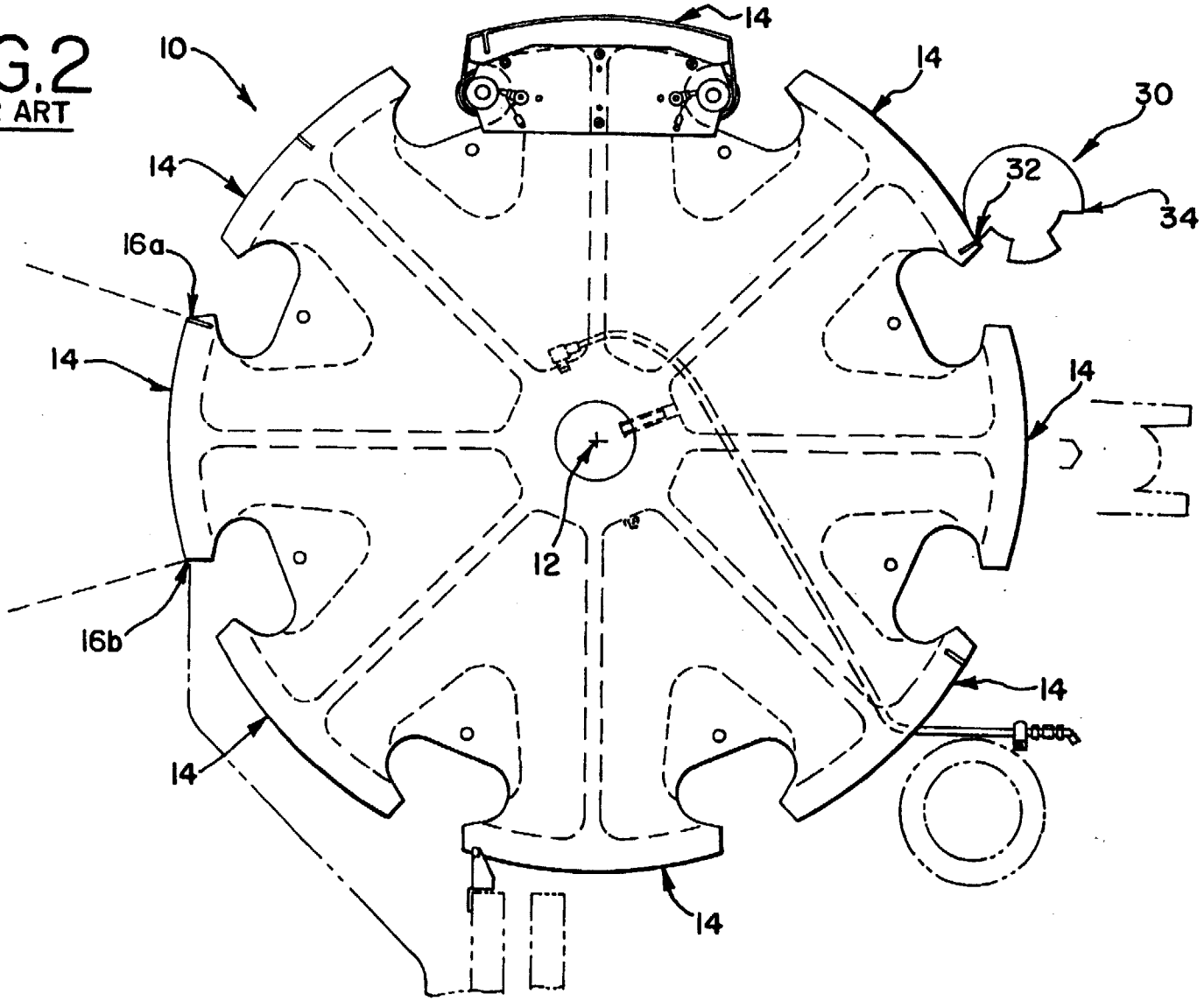
FIG. 2 PRIOR ART
Figure 4:
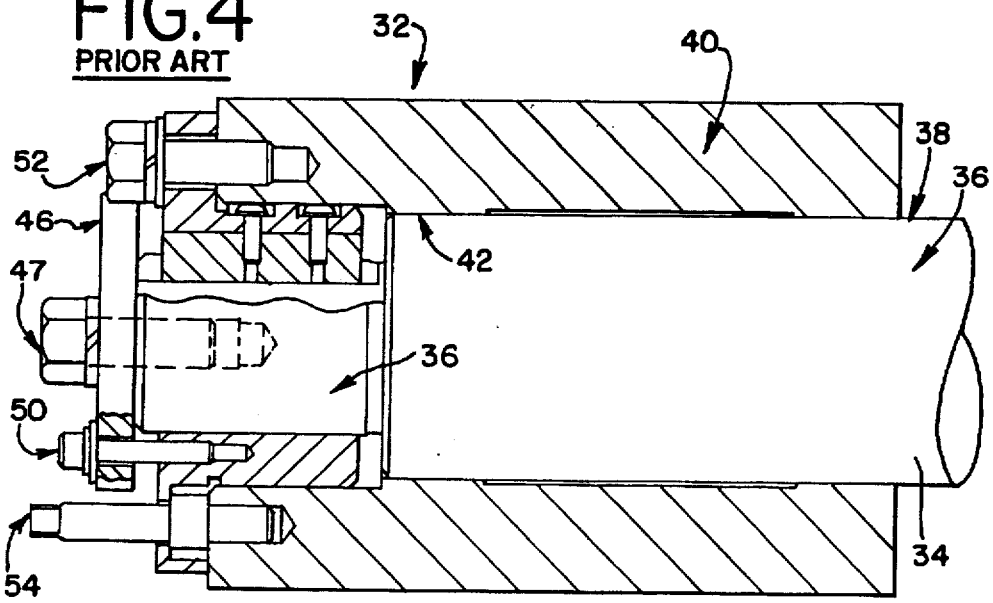
FIG.4 PRIOR ART
Figure 3:
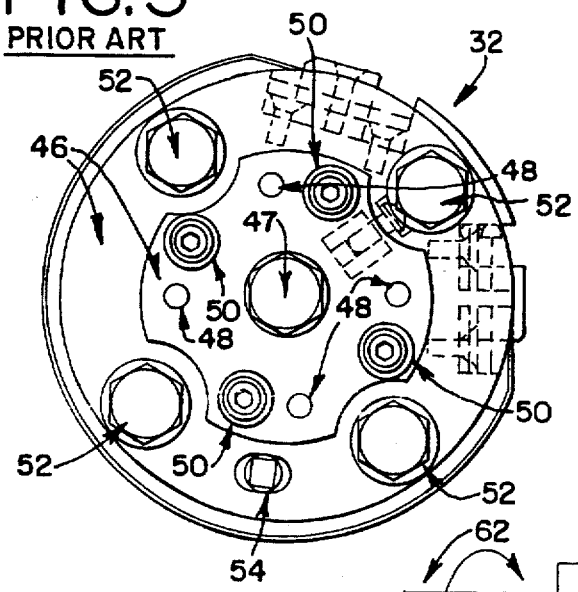
FIG.3 PRIOR ART
Figure 5:
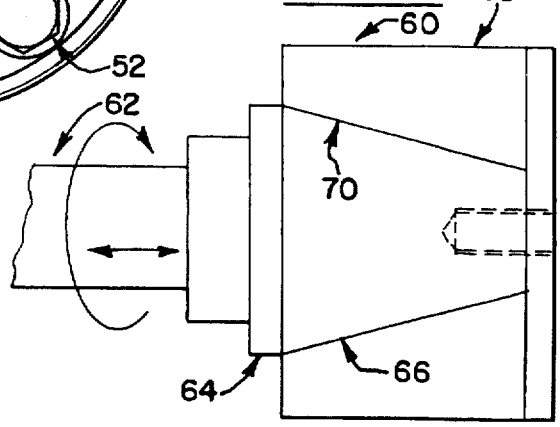
FIG.5 PRIOR ART
Figure 7:
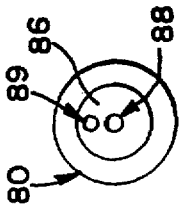
Figure 6:
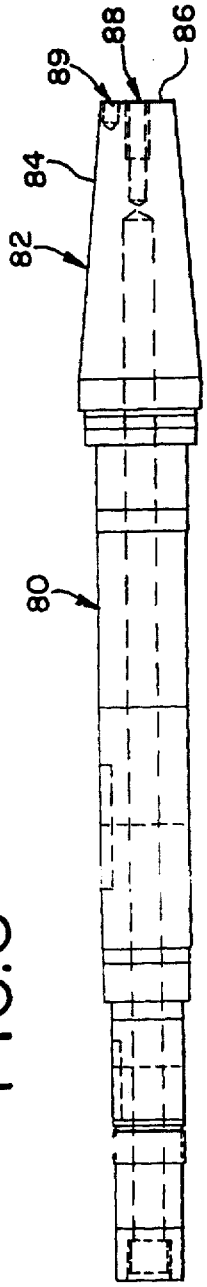
Figure 9:
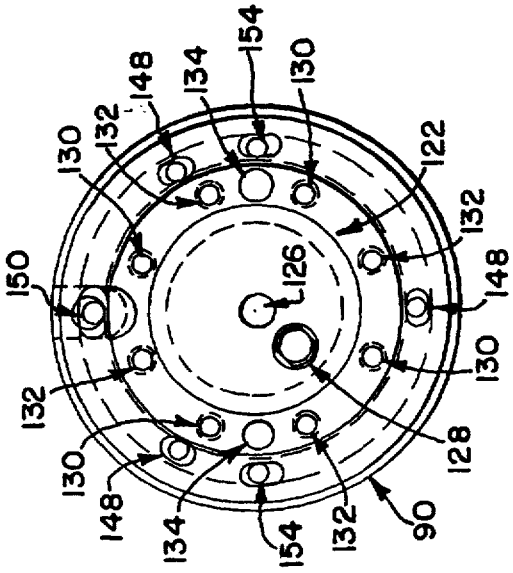
Figure 8:
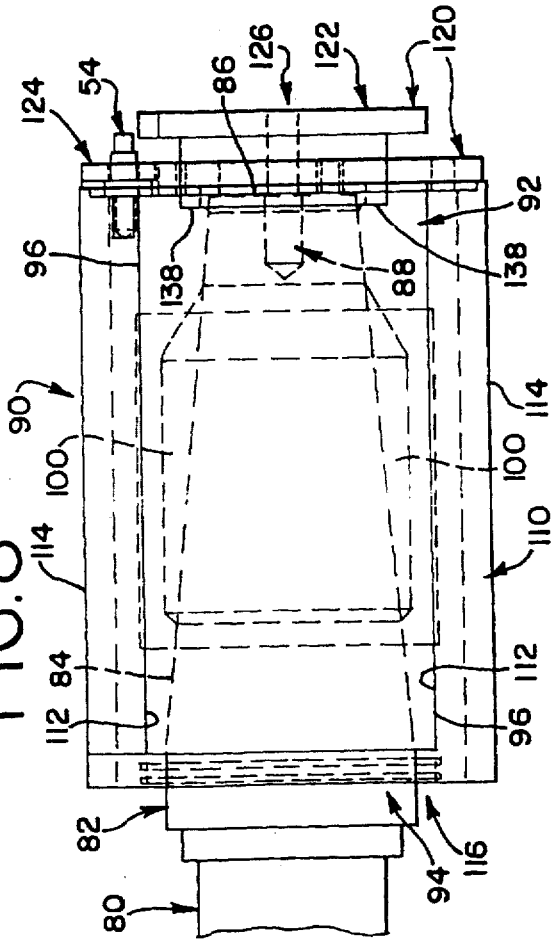
Figure 11:
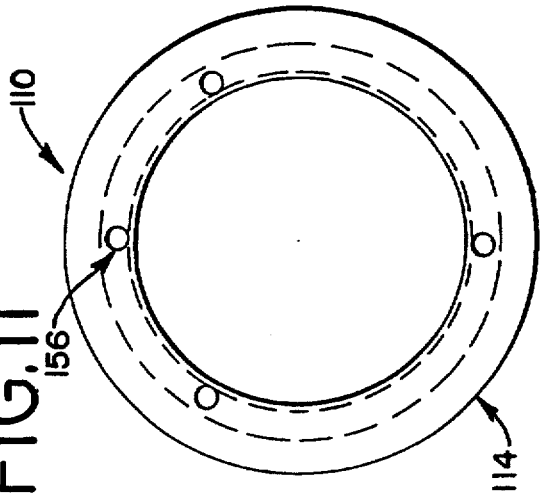
Figure 13:
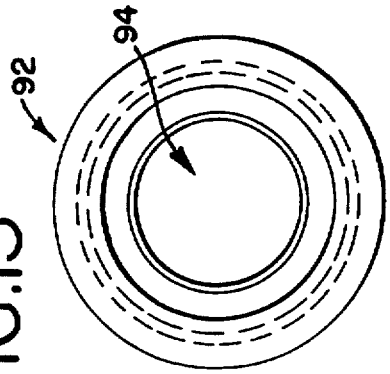
Figure 10:
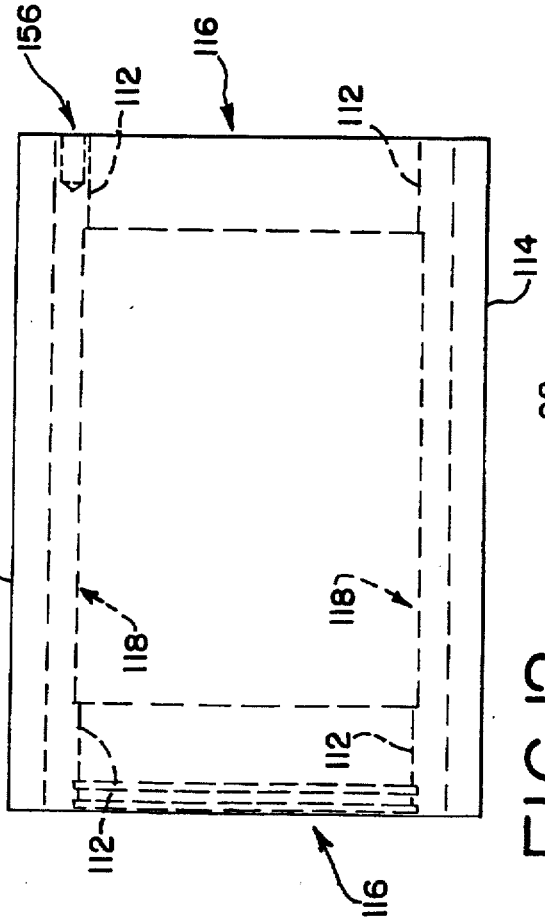
Figure 12:
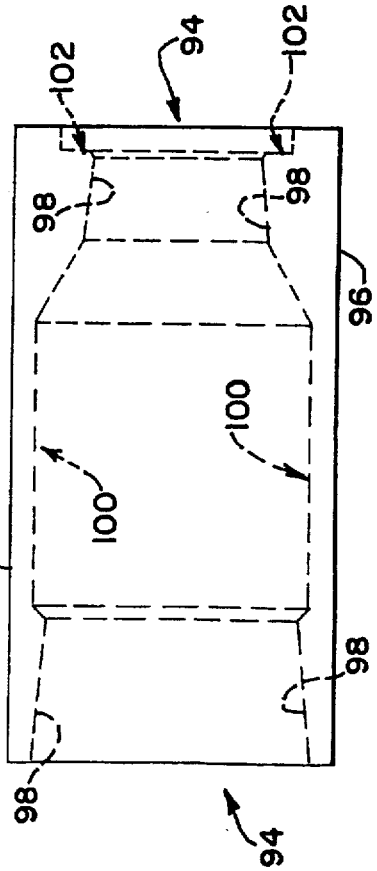
Figure 14:
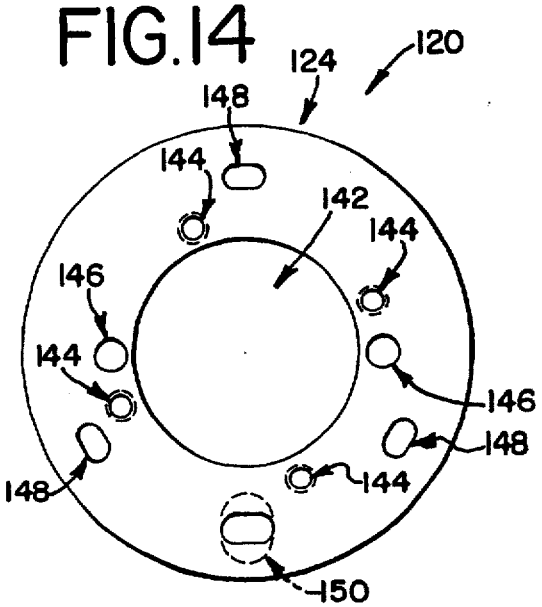
Figure 15:
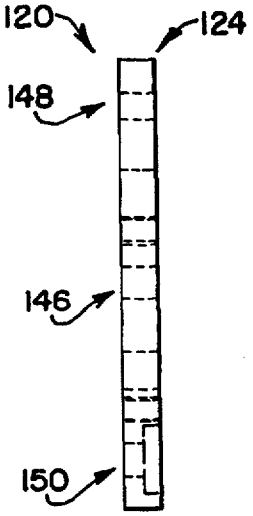
Figure 16:
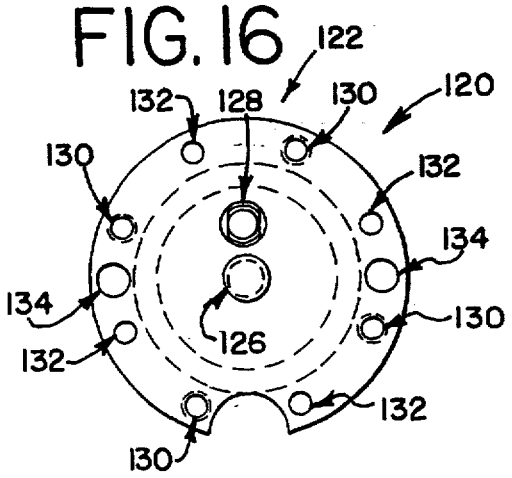
Figure 17:
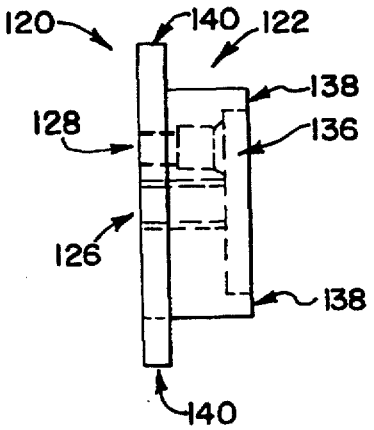
Figure 18:
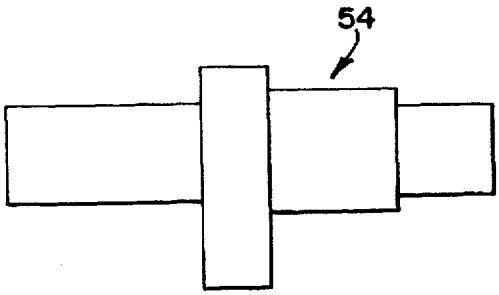
Figure 19:
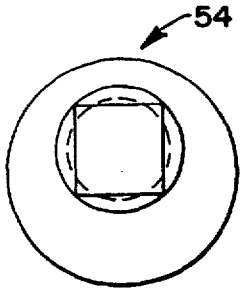
Figure 20:
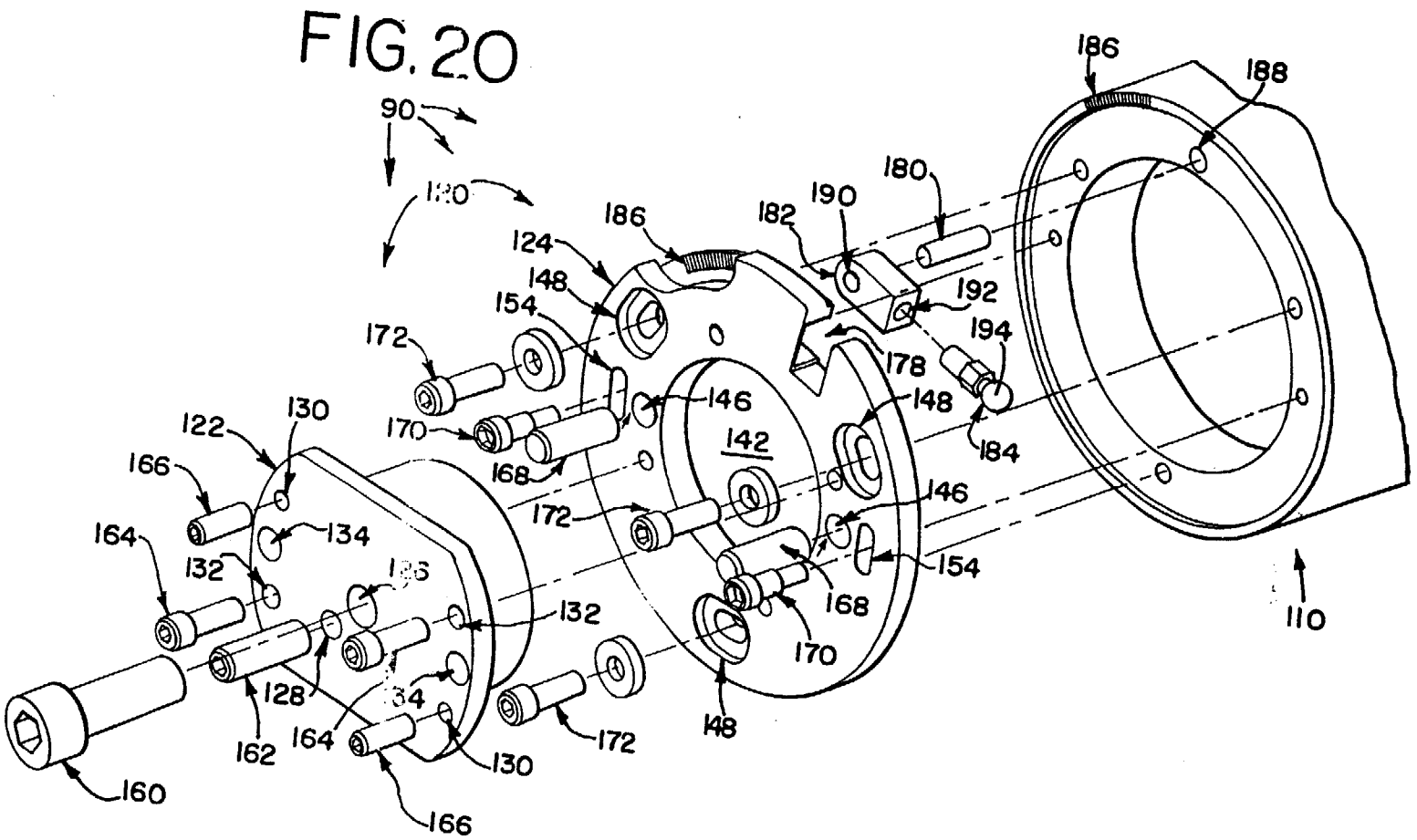
Figure 22:
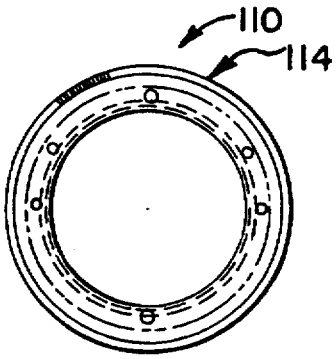
Figure 21:
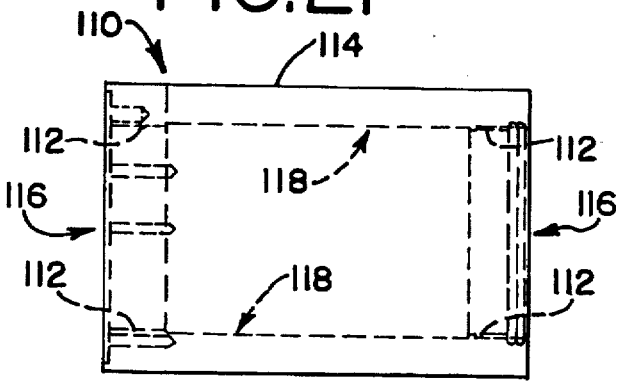
Figure 23:
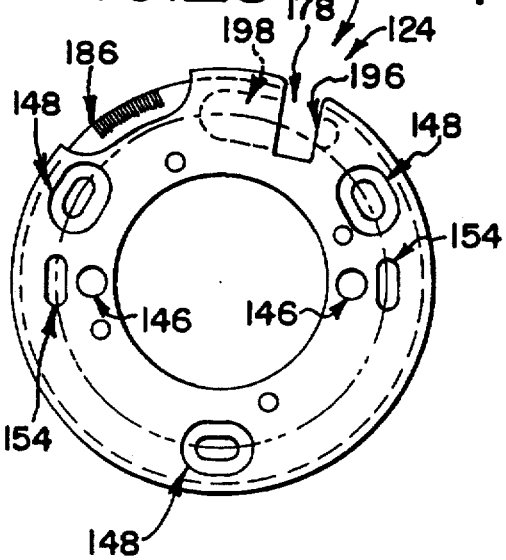
Figure 24:
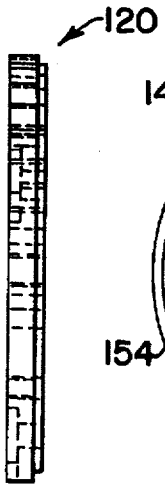
Figure 25:
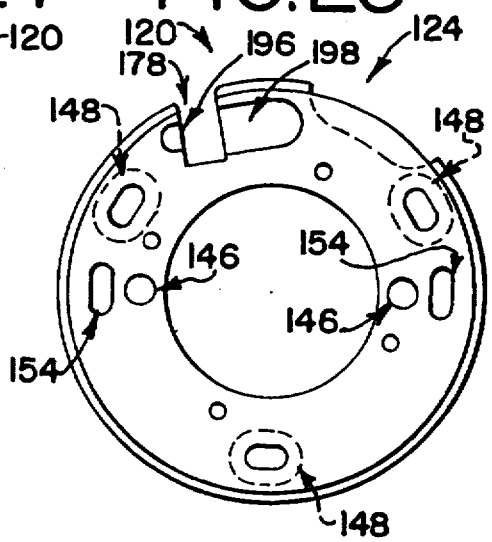
Figure 26:
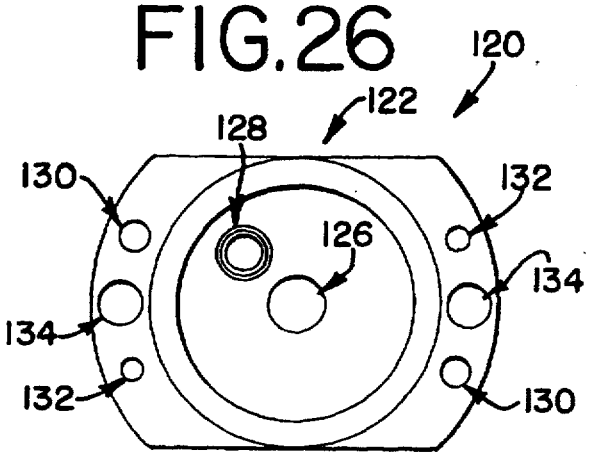
Figure 27:
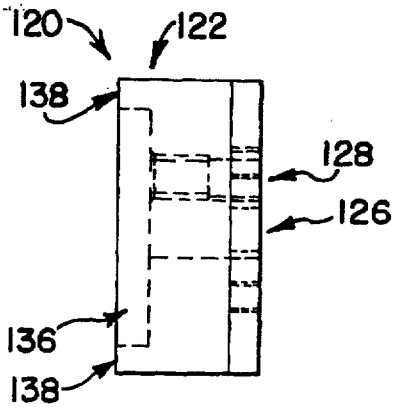
Figure 28:
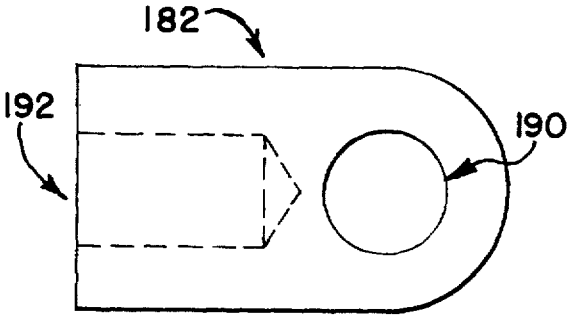
Figure 29:
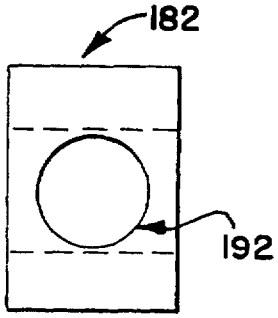
Figure 30:
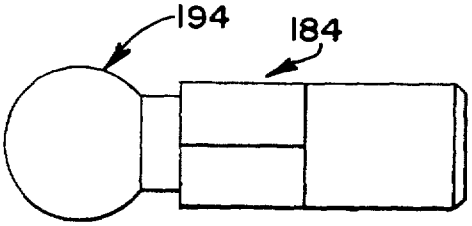
Figure 31:
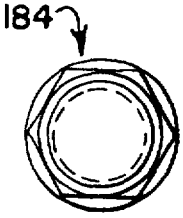

The rotation adjustment amount can be measured by the index 186. Specifically, the lines of the index on the exterior member 110 are appropriately compared to the lines of the index 186 on the exterior plate 124, as shown in FIG. 20. The index 186 shown in the embodiment of FIGS. 20–31 in combination with the rest of the registration adjustment assembly is preferable to the previous embodiment(s), as rotation adjustment with an eccentric 54 can be more difficult to measure. Specifically, operators sometimes forget that typical eccentric 54 rotation in one direction causes the exterior member 110, with respect to the interior member 92, to rotate in the opposite direction than the eccentric 54 rotation.

The two piece printing head 90 of the present invention can be mounted to a tapered shaft head 82 and provides for separate axial and rotational alignment of the decorator surface or side wall 114, without moving the printing shaft 80. Accordingly, the printing head 90 of the present invention can be advantageously utilized in decorator machines with and without adjustable printing shafts.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

It is claimed:

1. A printing head adapted for engagement with a tapered printing shaft, for a decorator cylinder assembly, comprising:

an interior member having a shaft bore and an outer side wall, the shaft bore having a tapered interior side wall, for engagement with the tapered printing shaft;

an exterior member having an inner side wall and a decorator side wall, the exterior member at least partially encompassing the interior member, the exterior member being adjustably connected about the interior member when the interior member is engaged with the tapered printing shaft; and, an adjustment member adjustably connected to the interior member and the exterior member.

2. The printing head of claim 1 wherein the outer side wall of the interior member abuts the inner side wall of the exterior member.

3. The printing head of claim 1 wherein the decorator side wall is a generally cylindrical surface.

4. The printing head of claim 1 wherein the outer side wall is a generally cylindrical surface.

5. The printing head of claim 1 wherein the tapered interior side wall of the shaft bore includes an interior relief area.

6. The printing head of claim 1 wherein the inner side wall of the exterior member has an inner relief area.

7. The printing head of claim 1 wherein the exterior member is at least partially axially adjustable about the interior member.

8. The printing head of claim 1 wherein the exterior member is at least partially rotatably adjustable about the interior member.

9. The printing head of claim 1 wherein the face plate of the printing head includes an interior plate and an exterior plate.

10. The printing head of claim 9 wherein the decorator cylinder assembly includes a rotatable printing shaft with a tapered shaft head, wherein the interior plate includes a central retaining bore, and wherein the tapered shaft head includes a central retaining hole, the printing head further comprising a central retaining bolt for insertion through the central retaining bore and for insertion into the central retaining hole for retaining and fastening the interior plate to the tapered shaft head.

11. The printing head of claim 7 further comprising means for axially adjusting the exterior member about the interior member.

12. The printing head of claim 7 further comprising an adjustment screw for adjusting the axial position of the interior member in relation to the exterior member.

13. The printing head of claim 12 further comprising a jack screw for maintaining the axial position of the interior member in relation to the exterior member.

14. The printing head of claim 8 further comprising means for rotatably adjusting the exterior member about the interior member.

15. The printing head of claim 8 further comprising a registration adjuster for adjusting the rotation position of the interior member in relation to the exterior member.

16. The printing head of claim 15 further comprising a locking screw for maintaining the rotation position of the interior member in relation to the exterior member.

17. A printing head for a decorator cylinder assembly including a rotatable tapered printing shaft having a tapered shaft head, comprising:

an interior cylinder having a shaft bore and an outer side wall, the shaft bore having a tapered interior side wall for accepting and fixedly engaging the tapered shaft head, the interior cylinder being rotatable with the tapered printing shaft;

an exterior cylinder having an inner side wall and a decorator side wall, the exterior cylinder at least partially circumscribing the interior cylinder, wherein the outer side wall of the interior cylinder at least partially abuts the inner side wall of the exterior cylinder, the exterior cylinder being axially adjustable about the interior cylinder; and, an adjustment member adjustable connected to the interior member and the exterior member.

18. The printing head of claim 17 wherein the exterior cylinder is cylindrically adjustable about the interior cylinder.

19. The printing head of claim 17 wherein the adjustment member of the printing head includes an interior plate and an exterior plate.

20. The printing head of claim 19 wherein the interior plate includes a central retaining bore, and wherein the tapered shaft head includes a central retaining hole, the printing head further comprising a central retaining bolt for insertion through the central retaining bore and for insertion into the central retaining hole for retaining and fastening the interior plate to the tapered shaft head.

21. The printing head of claim 17 further comprising means for axially adjusting the exterior cylinder about the interior cylinder.

22. The printing head of claim 17 further comprising means for rotatably adjusting the exterior cylinder about the interior cylinder.

23. A printing head for a decorator cylinder assembly including a rotatable tapered printing shaft having a tapered shaft head, comprising:

an interior cylinder having a shaft bore and an outer side wall, the shaft bore having a tapered interior side wall for accepting and fixedly engaging the tapered shaft head, the interior cylinder being rotatable with the tapered printing shaft;

an exterior cylinder having an inner side wall and a decorator side wall, the exterior cylinder at least partially circumscribing the interior cylinder, wherein the outer side wall of the interior cylinder at least partially abuts the inner side wall of the exterior cylinder, the exterior cylinder being axially and cylindrically adjustable about the interior cylinder; and, an adjustment member adjustably connected to the interior cylinder and the exterior cylinder.

24. The printing head of claim 23 further comprising a rotation adjustment assembly including a registration adjuster, a pivot, and a pull dowel, the pull dowel pivotally connecting the pivot to the exterior cylinder, and the registration adjuster adjustably connecting the pivot to the adjustment member for adjusting the rotation position of the interior cylinder in relation to the exterior cylinder, the rotation adjustment assembly further including a locking screw for maintaining the rotation position of the interior cylinder in relation to the exterior cylinder once the rotation position is adjusted.

* * * * *

UNITED STATES PATENT AND TRADEMARK OFFICE

CERTIFICATE OF CORRECTION

PATENT NO. : 5,819,648
DATED : October 13, 1998
INVENTOR(S) : Robert K. Megyesi

It is certified that error appears in the above-identified patent and that said Letters Patent is hereby corrected as shown below:

Column 1,
Line 19, Insert therefor -- is -- after the word piece

Column 3,
Line 58, Delete ")" after the word head

Column 8,
Line 18, Insert therefor -- of -- after the word plurality
Line 55, Insert therefor -- a -- after the word is Column 10,
Lines 39, 65, and 66, Delete "/adjustment member" after the word plate Column 11,
Lines 1, 53, and 64, Delete "/adjustment member" after the word plate
Line 43, Delete "." and insert "." befor the )

Column 12,
Line 52, Delete "/adjustment member" after the word plate
Line 53, Delete "adjustment" and insert therefor -- adjustably --

Column 13,
Line 26, Delete "/adjustment member" after the word plate

UNITED STATES PATENT AND TRADEMARK OFFICE

CERTIFICATE OF CORRECTION

PATENT NO. : 5,819,648
DATED : October 13, 1998
INVENTOR(S) : Robert K. Megyesi

It is certified that error appears in the above-identified patent and that said Letters Patent is hereby corrected as shown below:

Column 14,
Line 66, Delete "adjustable" and insert therefor -- adjustably --

In the Figures, Delete all Figures and replace with the attached nine pages of formal drawings (Figures 1-31).

Signed and Sealed this

Fourth Day of December, 2001

*Attest:*

Nicholas P. Godici

*Attesting Officer*

NICHOLAS P. GODICI
*Acting Director of the United States Patent and Trademark Office*

United States Patent [19]

Megyesi

[11] Patent Number: 5,819,648

[45] Date of Patent: Oct. 13, 1998

[54] TWO PIECE PRINTING HEAD FOR DECORATOR CYLINDER WITH TAPERED SHAFT

[75] Inventor: Robert J. Megyesi, White House, Ohio

[73] Assignee: American National Can Company, Chicago, Ill.

[21] Appl. No.: 704,317

[22] Filed: Sep. 12, 1996

[51] Int. Cl.[6] ..... B41F 17/08

[52] U.S. Cl. ..... 101/38.1; 101/216; 101/383

[58] Field of Search ..... 101/41, 216, 38.1, 101/40, 40.1, 248, 382.1, 383, 153

[56] References Cited

U.S. PATENT DOCUMENTS

| | | | |
|---|---|---|---|
| 1,802,038 | 4/1931 | Springstead | 101/248 |
| 3,783,780 | 1/1974 | Saueressig | 101/216 |
| 4,380,964 | 4/1983 | Abe et al. | 101/38.1 |

OTHER PUBLICATIONS

Entire manual for operation, maintenance and parts replacement for Rutherford Container Decorator 6CD4–1600, Rutherford Machinery, a Division of Sequa Corporation, 401 Central Avenue, East Rutherford, New Jersey 07073 (author) (no date).

Entire manual for operation and maintenance of the Concord Decorator, Ragsdale Machinery Operations, a Division of Alcoa Packaging Machinery, Inc., 4535 South Santa Fe Drive, Englewood, CO 80110 (author) (no date).

*Primary Examiner*—Christopher A. Bennett
*Attorney, Agent, or Firm*—Wallenstein & Wagner, Ltd.

[57] ABSTRACT

The present invention is a printing head for a decorator cylinder assembly and comprises an interior member having a shaft bore and an outer side wall. The shaft bore has a tapered interior side wall. The printing head further comprises an exterior member having an inner side wall and a decorator side wall. The exterior member at least partially encompasses the interior member. The outer side wall of the interior member at least partially abuts the inner side wall of the exterior member, and the exterior member is adjustably connected about the interior member. The exterior member is at least partially axially adjustable about the interior cylinder, and is at least partially rotatably adjustable about the interior cylinder. The printing head further comprises a face plate/adjustment member adjustably connected to the interior member and the exterior member.

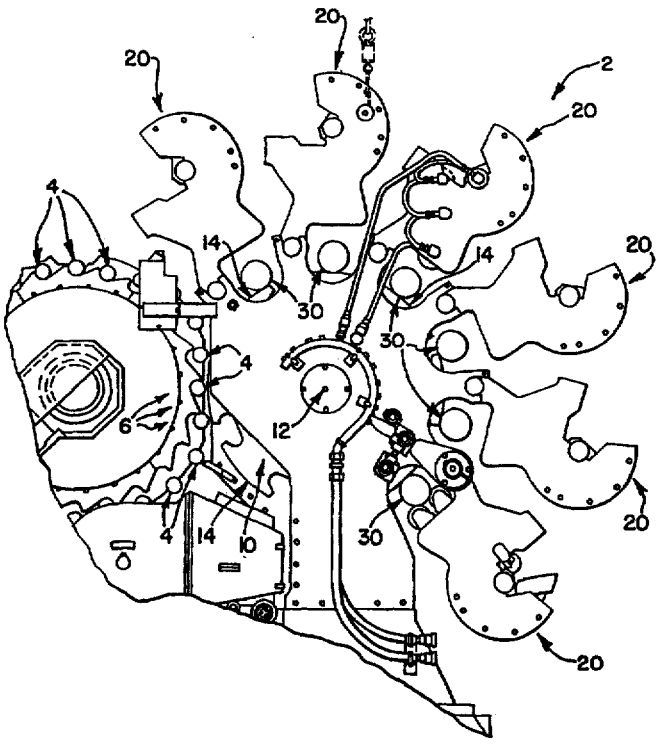

24 Claims, 16 Drawing Sheets